US006356176B1

(12) United States Patent
Anderson

(10) Patent No.: US 6,356,176 B1
(45) **Date of Patent: *Mar. 12, 2002**

(54) HIGH ENERGY MAGNETIZER/ DEMAGNETIZER WITH MAGNETICALLY ATTACHED FASTENING ELEMENT FOR DRIVING TOOLS

(76) Inventor: Wayne Anderson, 65 Grove St., Northport, NY (US) 11768

( * ) Notice: Subject to any disclaimer, the term of this patent is extended or adjusted under 35 U.S.C. 154(b) by 0 days.

This patent is subject to a terminal disclaimer.

(21) Appl. No.: 09/489,484

(22) Filed: Jan. 21, 2000

Related U.S. Application Data

(63) Continuation-in-part of application No. 09/161,855, filed on Sep. 28, 1998, now Pat. No. 6,026,718, and a continuation-in-part of application No. 09/161,851, filed on Sep. 28, 1998, now Pat. No. 6,130,507, and a continuation-in-part of application No. 09/376,590, filed on Aug. 18, 1999, now Pat. No. 6,181,229.

(51) Int. Cl.[7] ..... H01F 13/00
(52) U.S. Cl. ..... 335/284; 81/451; 206/350
(58) Field of Search ..... 335/302–306, 335/284; 248/70, 70.6, 70.7, 307, 309.1, 309.2, 309.3, 309.4; 206/350; 81/125, 451; 7/125–129

(56) References Cited

U.S. PATENT DOCUMENTS 5,794,497 A * 8/1998 Anderson ..... 81/451
6,060,801 A * 5/2000 Anderson ..... 310/50

* cited by examiner

*Primary Examiner*—Lincoln Donovan
(74) *Attorney, Agent, or Firm*—Lackenbach Siegel

(57) ABSTRACT

A high energy magnetizer/demagnetizer unit for a magnetizable tool bit for driving the head of a fastening device or the like comprising an elongated permanent magnet having opposed first and second poles arranged on a non-operative portion of the driving tool or the like to permit placement of a magnetizable tool bit on the elongated magnet at the first position associated with the first pole to magnetize the tool bit and also to permit placement of the tool bit at a second position associated with the second pole to demagnetize the tool bit, the second position being at a predetermined distance from the magnet. The elongated magnet defines a holding area to permit placement of at least one fastening device at a third position on the elongated magnet associated with the second pole. The fastening device is held at the third position by magnetic force at the unit is adherently attached to a driving tool and transported to a work area where the magnetized fastener and the oppositely charged tool bit are connected to the tool. Unit mounting means holds the elongated magnet and provides first and third accesses at the first and third positions, respectively, to the elongated magnet and for provides the predetermined distance at the second position. The elongated magnet is either a single elongated high energy magnet or can comprise a high energy magnet portion and an elongated shunt portion. The magnetizer/demagnetizer is either separately attached to the housing of the power tool or is unitary with the housing.

65 Claims, 12 Drawing Sheets

HIGH ENERGY MAGNETIZER/ DEMAGNETIZER WITH MAGNETICALLY ATTACHED FASTENING ELEMENT FOR DRIVING TOOLS

RELATED APPLICATION

This application is a continuation-in-part application of Ser. No. 09/161,855, filed Sep. 28, 1998, now U.S. Pat. No. 6,026,718, and a continuation-in-part application of Ser. No. 09/161,851, also filed on Sep. 28, 1998, now U.S. Pat. No. 6,130,507 and a continuation-in-part application of Ser. No. 09/376,590 filed Aug. 18, 1999, now U.S. Pat. No. 6,181, 229.

BACKGROUND OF THE INVENTION

1. Field of the Invention

The present invention generally relates to tools, and more specifically to a high energy permanent magnet magnetizer and a demagnetizer for magnetizing and/or demagnetizing a magnetizable element such as a driver bit, a fastener, and the like, for driving tools.

2. Description of the Prior Art

It is frequently desirable to magnetize the tips of screwdriver bits, tweezers and the like to form at least a temporary magnetic pole magnetizable elements. Thus particularly with precision screwdrivers which tend to be relatively small and are used to drive relatively small head screws, it is frequently advantageous to at least temporarily magnetize the screwdriver tips of the driver bits to maintain the screwdriver blade or tip within the slot of a screw head or within the cross slots formed within the head of the screw adapted to receive the Phillips screwdriver tip. By magnetizing the tip of the driver bit, and mating screw head, the screw remains attached to the bit tip without the need to physically hold them together. This allows the screw to be guided through a relatively small bore or channel and moved within a confined space. Sometimes the magnetized tip of the driver bit is used to retrieve a metal item, such as a screw, washer, nail or the like, from an inaccessible place which would otherwise be difficult to reach with anything but a relatively thin shank of a driver bit. Of course, such attachment of a fastener to the driver bit tip also frees the user's hand for holding or positioning the work into which the fastener is to be driven. In some instances, rather than magnetizing the tip of the driver member bit, the fastener itself is magnetized so that, again, it is attracted to and remains magnetically attached to the driver bit tip in the same way as if the latter had been magnetized.

Conversely, there are instances in which a magnetized driver bit tip is disadvantageous, because it undesirably attracts and attaches to itself various magnetizable elements or components. Under such circumstances, it may be desirable to demagnetize a driver bit tip that had been originally magnetized in order to render same magnetically neutral.

Devices for magnetizing/demagnetizing tools and small parts are well known. These normally incorporate one or more permanent magnets which create a sufficiently high magnetic field to magnetize at least a portion of a magnetizable element brought into its field. The body can be magnetized by bringing it into the magnetic field. While the magnetic properties of all materials make them respondent in some way to magnetic fields, most materials are diamagnetic or paramagnetic and show almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Hard materials are used to supply fixed fields either to act alone, as in a magnetic separator, or interact with others, as in loudspeakers, electronic instruments and test equipment.

Most magnetizers/demagnetizers include commercial magnets which are formed of either Alnico or of ceramic materials. The driver members/fasteners, on the other hand, are normally made of soft materials which are readily magnetized but more easily lose their magnetization, such as by being drawn over an iron or steel surface, subjected to a demagnetizing influence such as strong electromagnetic fields or other permanent magnetic fields, severe mechanical shock or extreme temperature variations.

One example of a stand alone magnetizer/demagnetizer is magnetizer/demagnetizer Model No. 40010, made in Germany by Wiha. This unit consists of a plastic box that has two adjacent openings defined by three spaced transverse portions. Magnets are placed within the transverse portions to provide magnetic fields in each of the two openings which are directed in substantially opposing directions. Therefore, when a magnetizable tool bit or any magnetizable component is placed within one of the openings, it becomes magnetized and when placed in the other of the openings, it becomes demagnetized. The demagnetizing window is provided with progressive steps to stepwise decrease the air gap for the demagnetizing field and, therefore, provides different levels of strengths of the demagnetizing field. However, common magnetic materials that are used with conventional magnetizers/demagnetizers include Alnico and ceramic magnets which typically have energy products equal to approximately $4.5\times10^6$ gauss-oersteds and $2.2\times10^6$ gauss-oersteds, respectively.

Since the magnetic field strength "B" at the pole of the magnet is a product of the unit field strength and the area, it follows that the energy content is proportional to the BH product of the magnet. The BH product is a quantity of importance for a permanent magnet and is probably the best single "figure of merit" or criterion for judging the quality of the permanent magnetic material. It is for this reason that conventional magnetizers/demagnetizers have required significant volumes of magnetic material to provide the desired energy content suitable for magnetizing and demagnetizing parts. However, the required volumes have rendered it impossible or impractical to incorporate the magnetizers/demagnetizers on relatively small hand tools. Thus, for example, precision screwdrivers, which are relatively small and have relatively small diameter handles, could not possibly incorporate sufficient magnetic material to provide desired levels of magnetic fields for magnetizing and demagnetizing parts. However, the requirement of using separate magnetizer/demagnetizer units has rendered their use less practical. Thus, unless the user of a precision screwdriver or any driver tool acquired a separate magnetizer/demagnetizer, one would not normally be available for use. Additionally, even if such magnetizer/demagnetizer were available, it would still require a separate component that could be misplaced and not be available when needed. Additionally, there is always the risk that the magnetizer/demagnetizer could become misplaced or lost, rendering the use of the driver tool less useful.

Another problem with prior art magnetizers/demagnetizers is that they fail to address the problem that during demagnetization the element being demagnetized may be either insufficiently demagnetized or overly demagnetized to effectively re-magnetize the element with opposing polarity. Thus, prior art magnetizers/demagnetizers have failed to consider the importance of the strengths of the magnets and the sizes of the elements being magnetized and demagnetized. Thus, typically, the larger the element, the more magnetic field required to demagnetize it. However, demagnetization of all sized elements within the same field may result in some elements being insufficiently demagnetized, while others become overly demagnetized. In either case, the end result is unsatisfactory in that an element which was intended to be demagnetized continues to exhibit magnetic poles and generate a magnetic field.

Prior applications Ser. Nos. 09/161,851 and 09/161,855 involved high energy magnetizer/demagnetizers related to driver tools that described inventive magnetizer/demagnetize features for engagement of the driving tip of a driver tool with a fastener such as a Phillips head screw and inventive provision for the placement of the magnetized element in a suitable demagnetizing field.

Neither of these inventions, however, provided a magnetizer/demagnetizer unit for magnetizing and demagnetizing driver tool bits that in addition provides for magnetizing a fastening element, or elements, such as a Phillips screw or screws, and for holding or storing the same magnetized element, or elements, on an opposing magnetic field of the same magnetizer/demagnetizer unit, so that the user can transport the e.g. driver tool with the magnetized unit to a work area and then remove the stored magnetized screw or screws for driving the magnetized screw or screws into the work object.

SUMMARY OF THE INVENTION

It is an object of the present invention to provide a high energy magnetizer/demagnetizer for a driving tool bit that also includes a magnetized area for holding a magnetizable fastening element or elements such as a screw or screws for transportation of the same to or holding same at a work area.

It is another object of the present invention to provide a magnetizer/demagnetizer as aforementioned which provides sufficiently strong magnetic fields to effectively and adequately magnetize/demagnetize a driver bit of the driving tool while also providing a magnetized holding area for storing the fastening element or elements by magnetic attraction to a work area.

It is still another object of the present invention to provide a magnetizer/demagnetizer as in the previous objects in which the magnetizer/demagnetizer including the magnetized holding area is a stand-alone unit that is adherently attached to a non-operative portion of the driving tool or other useful surface.

It is yet another object of the present invention to provide a magnetizer/demagnetizer as in the previous objects that includes the magnetized holding area that is unitary or integral with a non-operative portion of the driving tool.

It is yet another object of the present invention to provide a magnetizer/demagnetizer as in the previous objects that includes a magnetized holding area for holding a fastening element or elements such as a screw or screws wherein the magnet is an elongate magnet, or bar magnet, that provides a sufficient holding area that can hold at least one screw by magnetic attraction.

It is yet another object of the present invention to provide a magnetizer/demagnetizer as in the previous objects that includes a magnetized holding area for holding a fastening element of elements such as a screw or screws wherein the magnet is a composite super magnet and a magnetizable elongated shunt magnetized by the super magnet, such as a steel shunt, wherein the shunt provides a sufficient holding area than can store at least one fastening element or a plurality of fastening elements by magnetic attraction.

It is yet another object of the present invention to provide an elongated, or bar, magnetizer/demagnetizer which uses a permanent magnetic material having an energy product equal to at least $7.0\times10^6$ gauss-oersteds.

The magnetizer/demagnetizer of the present invention may be alternatively secured to, in addition to driver tool housings, other useful metallic and non-metallic surfaces, which by way of example include, the top of a ladder, adjacent a work area, a tool box cover and the user's work belt.

In order to achieve the above objects, as well as others which will become apparent hereinafter, there is provided a high energy magnetizer/demagnetizer in combination with a power driving tool including a magnetizable tool bit for driving the head of a fastening device or the like comprising an elongated permanent magnet having opposed first and second poles arranged on a non-operative portion of the driving tool or the like to permit placement of a magnetizable tool bit on the elongated magnet at the first position associated with the first pole to magnetize the tool bit and also to permit placement of the tool bit at a second position associated with the second pole to demagnetize the tool bit, the second position being at a predetermined distance from the magnet. The elongated magnet defines a holding area to permit placement of at least one fastening device at a third position on the elongated magnet associated with the second pole. The fastening device is held at the third position by magnetic force and can then be carried with the driving tool to a work area where the magnetized fastener and the oppositely charged tool bit are connected during the work. Mounting means holds the elongated magnet and provides first and third accesses at the first and third positions, respectively, to the elongated magnet and for provides the predetermined distance at the second position. The elongated magnet can be either a single elongated high energy magnet or can comprises a high energy magnet portion and an elongated shunt portion. The magnetizer/demagnetizer is either separately attached to the housing of the power tool or is unitary with the housing.

As will be evident from the discussion of FIG. 18, the magnetic force required to magnetize a magnetizable material is significantly greater than the magnetic force required to demagnetize that material. A feature of the invention is the arrangement of the magnet herein in such a way that the demagnetizing of a driver tool bit is accomplished at the predetermined distance from the magnet so that the demagnetizing force is less than the magnetizing force. While the predetermined distance is not critical, it should be selected to generally correspond to the magnetizing and demagnetizing forces required to magnetize and to demagnetize a driver tool bit. The magnetizing and demagnetizing forces are a function both of the size of the driver tool bit and also the material from which driver tool bit is made. The material of both driver tool bit and also the screw is significant as is evident from FIG. 18, where the it is shown that different materials show different magnetic properties, requiring different magnetic intensities or magnetizing forces to produce the same magnitudes of magnetic field or magnetic flux. The dimensions of the material to be magnetized and demagnetized are also important, because the more volume that the driver tool bit and the screw each have, the greater the magnetic field that will be required, since what is instrumental in magnetizing and demagnetizing the material is not only the absolute intensity of the magnetic field but also the relative density of the field taken across a given cross-sectional area of the tool, screw, that is, the magnetizable material.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
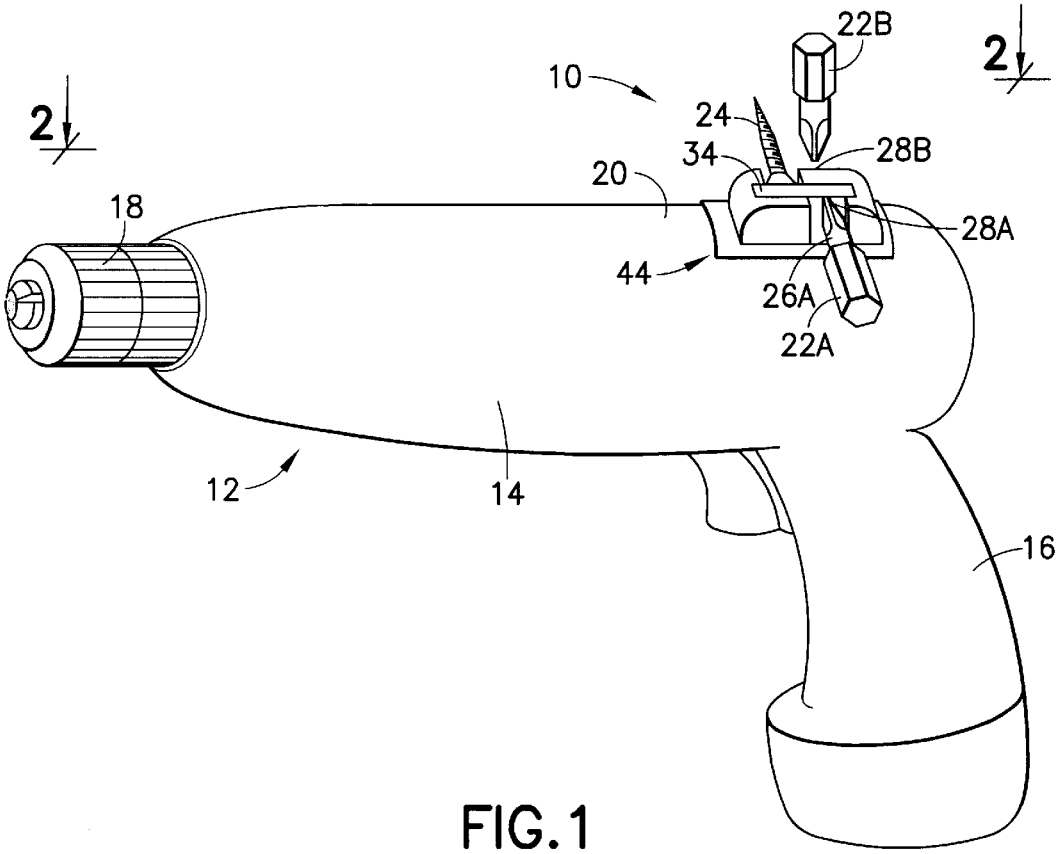
FIG. 1 is a perspective view of a portable power tool screwdriver illustrating a high energy magnetizer/demagnetizer unit attached to the surface of a rear portion of the power driver housing and also illustrating a Phillips driver screw bit positioned in the magnetizing portion of a bar magnet, the same Phillips screw bit being alternatively positioned in the demagnetizing portion of the magnetizer/demagnetizer unit, and further illustrating a Phillips head screw magnetically attached to a holding area of the magnetizer/demagnetizer unit.

Reference is now made to the figures in which identical or similar parts are designated by the same reference numerals throughout.

Figure 1A:
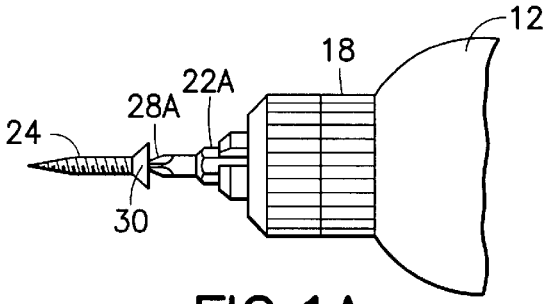
FIG. 1A is a broken partial side view of the chuck portion taken in isolation of the power driver shown in FIG. 1 showing mounting the Phillips screw bit as shown in FIG. 1 in a magnetized working mode in preparation for driving the magnetized Phillips head screw.
Figure 2:
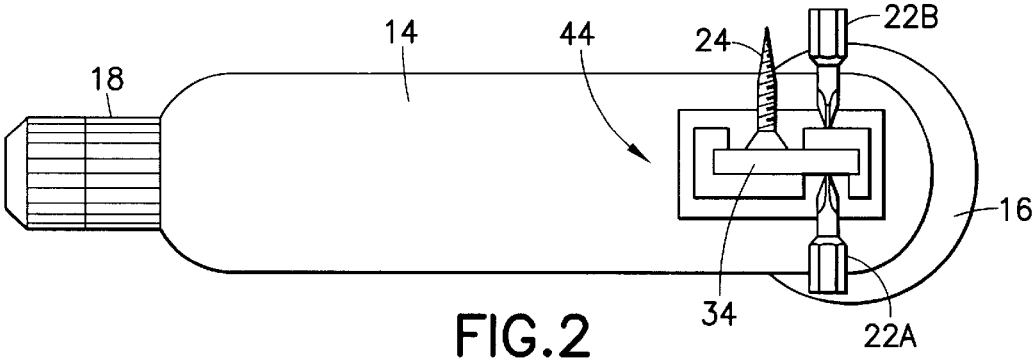
FIG. 2 is a top view taken through plane 2—2 of FIG. 1.

As shown in FIGS. 1 and 2, a high energy magnetizer/demagnetizer 10 is attached to a portable power driving tool 12, which is shown for purposes of exposition as a Phillips power driving tool. Power driving tool 12 includes a non-magnetizable housing 14, a handle 16, and a chuck 18. Magnetizer/demagnetizer 10 is mounted to a non-operative portion 20 of housing 14, which is shown for purposes of exposition as the upper rear area of housing 14. A magnetized driver tool bit 22A is shown secured to chuck 18 in FIG. 2 locked into position for driving the head of a fastening device such a Phillips screw 24 into a work piece (not shown). Driver tool bit 22A includes a shank 26 and a tool bit tip 28A which includes a screwdriver tip blade that is shown in FIG. 1A mating with the slots of screw head 30 of a Phillips screw 32. As shown in FIG. 2, tool bit 22A and Phillips screw 32, in particular screwdriver bit tip 28A and screw head 30, are magnetized with opposite polarities so that the entire screw 32 is magnetically held to tool bit 22A. As shown in FIGS. 1, 2, 3, and 4, a permanent high energy elongated bar magnet 34 that is shown for purposes of exposition only to be rectangular in configuration has a long dimension and a short dimension. The long dimension has opposed north and south poles indicated as N and S, respectively, that are separated across the short dimension. The pole designations can be reversed for the purposes of this application. Elongated magnet 34 is of such length, or of longitudinal dimension, that placement of tool bit 22A is permitted on elongated magnet 34 at a first position 36 associated with the north pole N to magnetize tool bit 22A. Elongated magnet 34 permits placement of tool bit 22B at a second position 38 associated with south pole S to demagnetize tool bit 22A. Second position 38 is positioned at a predetermined distance D from elongated magnet 34 as will be discussed in detail. Elongated magnet 34 permits placement of a fastening device, in particular, Phillips screw 24, at a third position 40 on elongated magnet 34 associated with south pole S. Third position 40 is spaced from first and second positions 36 and 38 and defines a screw holding area 42 on the surface of elongated magnet 34 that can accommodate screw head 30 in direct contact and so magnetize at least screw head 30 and thus hold screw 32 on the surface of elongated magnet 34.

Figure 3:
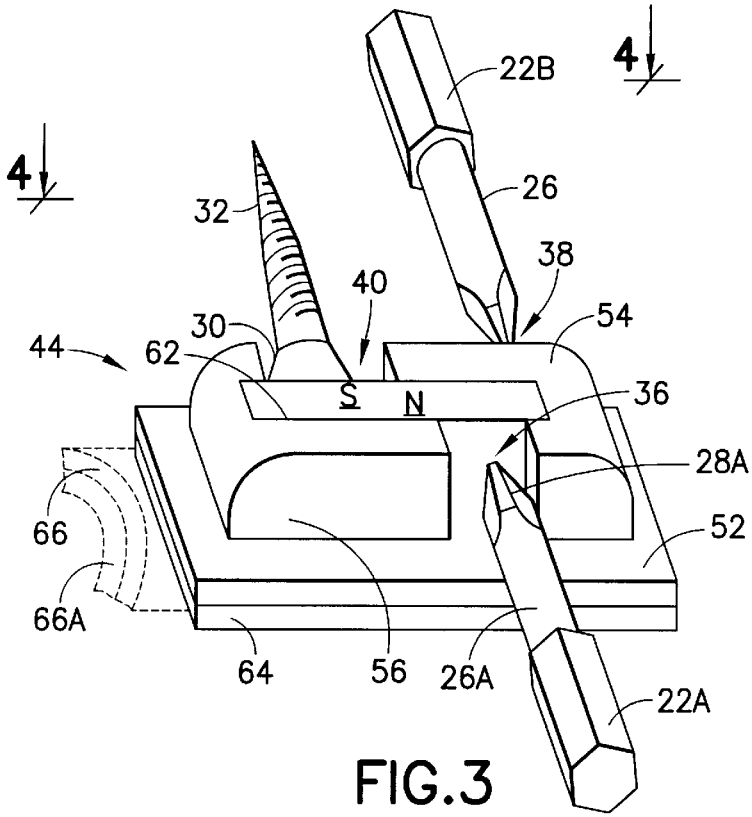
FIG. 3 is a perspective view of the magnetizer/demagnetizer unit similar to the unit shown FIGS. 1 and 2 shown in isolation having a flat mounting surface and also showing in phantom line an arcuate mounting surface for attachment to a curved surface such as the curved surface of the housing for the Phillips driver shown in FIG. 1 and further showing the Phillips driver bit positioned both at the magnetizing portion and at the demagnetizing portion and also showing the Phillips screw magnetically held at the holding area of the bar magnet of the magnetizer/demagnetizer unit and further showing the relative magnetizing and demagnetizing distances from the bar magnet.
Figure 4:
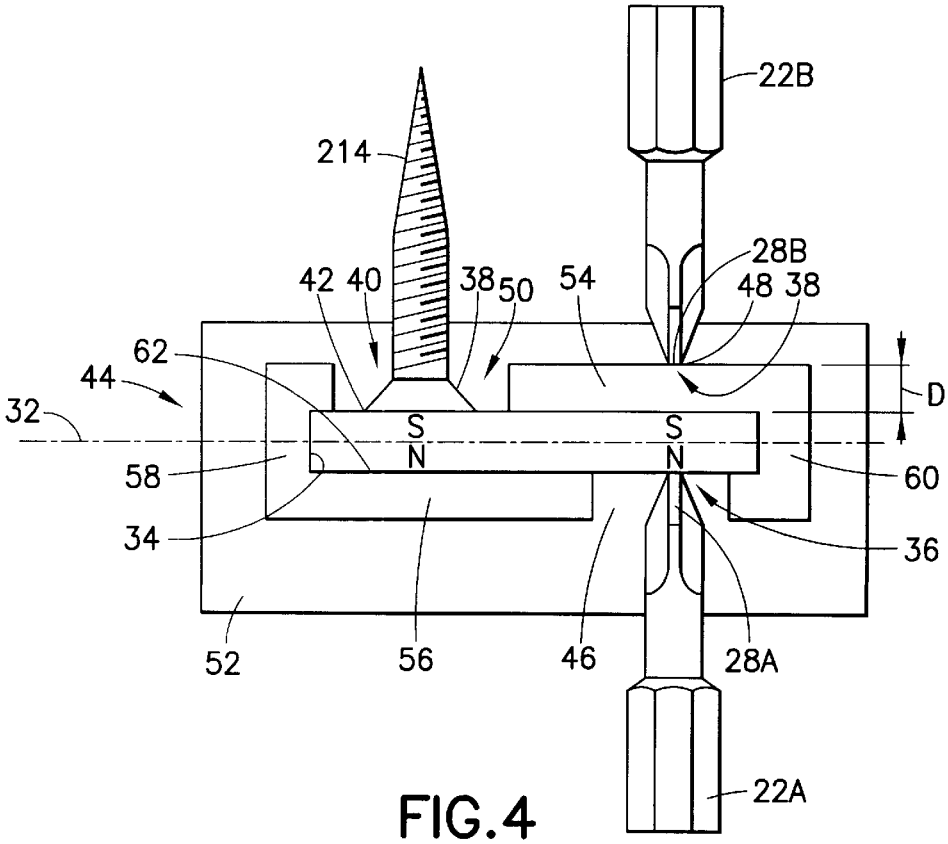
FIG. 4 is a top view taken through plane 4—4 of FIG. 3.

FIGS. 1 and 2 and in particular FIGS. 3 and 4 show magnetizer/demagnetizer 10 including a holding body 44 that mounts elongated magnet 34. Holding body 44 is made of a non-magnetizable material such as plastic. Holding body 44 provides a first access, or aperture, 46 associated with first position 36. Holding body 44 further provides a second access 48 associated with second position 38 for demagnification of tool bit 22A shown as tool bit 22B in the demagnetizing position in particular tool bit tip 28B that will be further set forth. Holding body 44 also provides a third access, or aperture, 50 associated with third position 40 for placement of a fastening device, in particular, screw 24 at third position 40 on elongated magnet 34 at south pole S so that screw 24 is held by magnetic force to elongated magnet 34 and to magnetizer/demagnetizer 10 and thus to power driving tool 12 while a user carries power driving tool 12 to a work area.

In addition, after tool bit 22A particularly tool bit tip 28 has been magnetized at a north pole N, when the user removes screw 32 from elongated magnet 34 and sets screw 32 at the work piece and then sets the magnetized tool bit 22 particularly magnetized tool bit tip 28 into the slots of magnetized screw 24, magnetized screw 24 is held to magnetized tool bit 22A by the force of magnetic attraction. After the completion of the work, namely, driving screw 24 into the work piece, there would ordinarily be no necessity to demagnetize magnetized screw 24. Demagnetization of tool bit 22A is accomplished at second position 38.

In particular, holding body 44 includes a mounting base 52 and a pair of opposed parallel end walls 54 and 56 connected to mounting base 52 and a pair of opposed parallel side walls 58 and 60 connected to end walls 54 and 56 and to mounting base 52 to form a generally rectangular structure having a longitudinal dimension defined by parallel side walls 58 and 60. Rectangular mounting base 52 extends slightly beyond both end walls 54 and 56 and both side walls 58 and 60. Mounting base 52, end walls 54 and 56, and side walls 58 and 60 define a rectangular recess 62 in which is positioned elongated magnet 34. Holding body 44 being elongated in the dimension of side walls 58 and 60 defines an elongated recess 62 that holds elongated magnet 34.

Side wall 58 forms first access 46 to elongated magnet 34 at first position 36 and second side wall 60 forms second access 48 at second position 38. Tool bit 22A is shown in FIGS. 3 and 4 positioned in magnetizing contact with elongated magnet 34 at first position 36 in particular positioned in first access 46. Tool bit 22A, in particularly tool bit tip 28, is magnetized by contact with elongated magnet 34 at first position 36. Screw 32 is magnetized by direct contact of screw head 30 with elongated magnet 34 at second position 38. Side wall 58 further forms third access, or aperture, 50 to elongated magnet 34 at third position 40 where screw head 30 of screw 24 is placed into direct magnetizing contact with elongated magnet 34.

As shown in FIG. 4, side wall 58 has a thickness of the predetermined distance D at second position 38, so that tool bit 22A with bit tip 28A now shown demagnetized tool bit 22B and bit tip 28B is demagnetized by touching tool bit tip 28A of tool bit 22A at second position 38 . Thus, side wall 58 provides second access 48 to elongated magnet 34 at second position 38.

An adhesive bottom side 64 of planar mounting base 50 shown in FIG. 3 can attach magnetizer/demagnetizer 10 to any flat or contoured surface. Mounting base 50 in the particular example of the invention shown in FIGS. 1 and 2 is contoured to fit onto the non-operative portion 20 of housing 14 of power driving tool 12 shown in FIGS. 1 and 2 as the top rear area of housing 14. FIG. 3 shows a contoured mounting base 66A in phantom line that fits onto housing 14 as shown in FIGS. 1 and 2. Elongated concave arcuate mounting base 66A has the base of the concavity extending longitudinally midway between side walls 58 and 60 so that magnetizer/demagnetize 10 shown in FIGS. 1 and 2 fits in the longitudinal direction on the curved surface of power tool housing 14. Contoured adhesive bottom side 66B also shown in phantom line is connected to contoured mounting base 66A for connecting holding body 44 to non-operative portion 20 of housing 14 of power driving tool 12. Mounting base 52 can be made of a flexible material such as plastic that can be contoured to fit onto onto a housing such as power tool housing 14 in a manner analogous to contoured mounting base 66. Adhesive bottom side 64 can likewise be made of a flexible material such as rubber cement that can be contoured along with a flexible mounting base 54. Flexible mounting base 52 can be flexibly adjusted to fit onto a power tool housing either in the long dimension or the short dimension.

Figure 5:
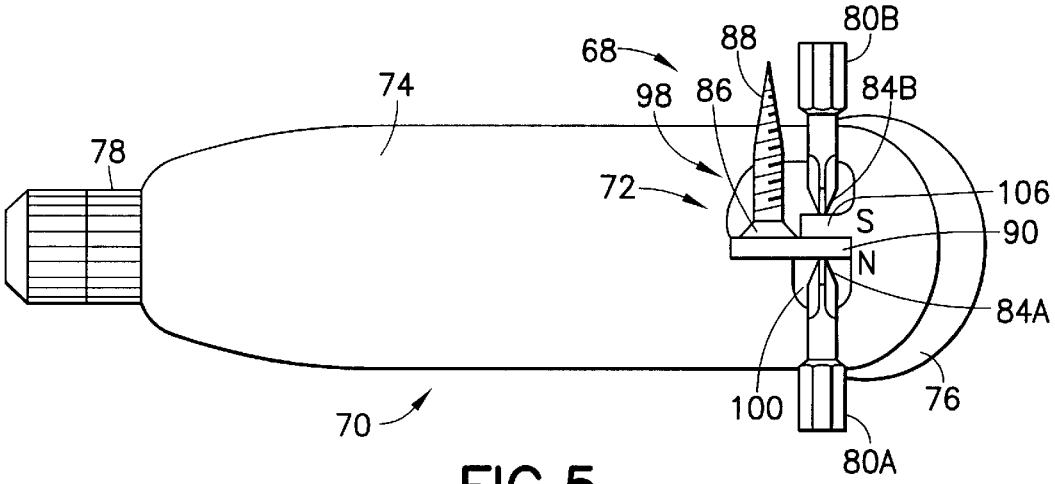
FIG. 5 is a top view of a portable Phillips power drill screwdriver illustrating a high energy magnetizer/demagnetizer unit analogous to the high energy magnetizer/demagnetizer shown in FIGS. 1, 2, and 4 that is integral with a rear portion of the power driver housing and also illustrating a Phillips drill tool bit positioned in the magnetizing position of a bar magnet and further illustrating the same Phillips driver tool bit positioned at the demagnetizing position and further showing a Phillips head screw magnetically attached to the screw holding area position of the magnetizer/demagnetizer unit.
Figure 6A:
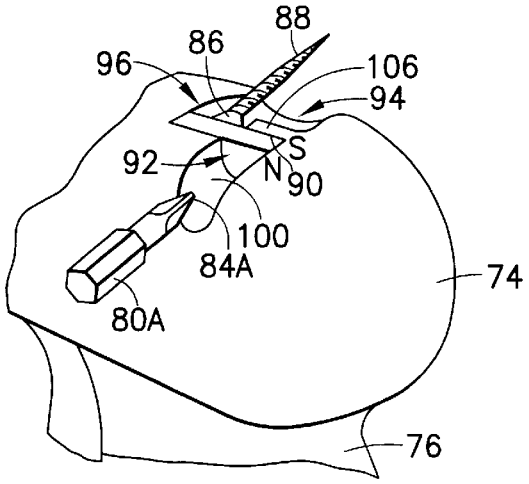
FIG. 6A is a perspective view of the left rear portion of the power driver housing shown in FIG. 5 further showing details of the integral magnetizer/demagnetizer shown in FIG. 5 with the Phillips drill tool bit shown positioned slightly spaced from the magnetizing area of the magnetizer/demagnetizer unit.
Figure 6B:
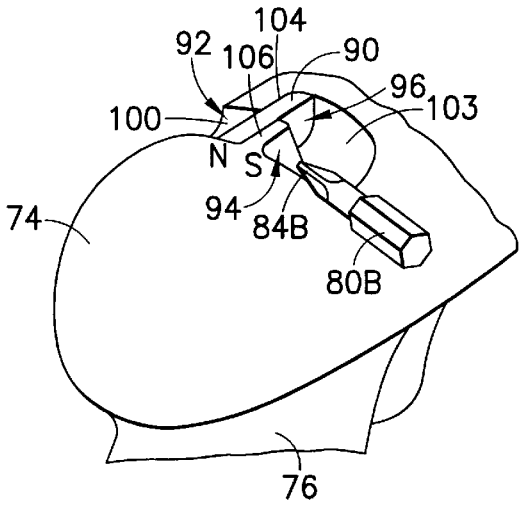
FIG. 6B is a perspective view of the right rear portion of the power driver housing shown in FIG. 5 further showing details of the integral magnetizer/demagnetizer shown in FIG. 5 with the Philips too bit shown positioned slightly spaced from the demagnetizing area of the magnetizer/demagnetizer unit.

FIGS. 5, 6A, and 6B show an alternate embodiment of the present invention where a magnetizer/demagnetizer 68 analogous to magnetizer/demagnetizer 10 is mounted integral with a power driving tool 70 at a non-operative portion 72 positioned at the top rear area of the power tool housing 74. Power driving tool 70 includes a non-magnetizable housing 74, a handle 76, and a chuck 78. Non-operative rear portion 72 is located over handle 76. A magnetizable driver tool bit 80A includes a shank 82 and a tool bit tip 84 the latter including a screwdriver tip blade that mates with the slots of the screw head 86 of a Phillips screw 88. In the same manner as shown in FIG. 1A, tool bit 80A and Phillips screw 88, in particular tool bit tip 84 and screw head 86, are magnetized with opposite polarities so that the entire screw 86 is magnetically held to tool bit 80A.

As shown in FIGS. 5, 6A, and 6B, a permanent high energy elongated bar magnet 90 that is shown for purposes of exposition only to be rectangular in configuration has a long dimension and a short dimension. The long dimension is shown for purposes of exposition to be aligned with the longitudinal dimension of power driving tool 70 in accord with the plane from chuck 78 to non-operative portion 72. The short dimension of elongated magnet 90 has opposed north and south poles indicated as N and S, respectively, that are separated across the short dimension.

Elongated magnet 90 permits a first position 92 associated with the north pole N to magnetize tool bit 80A. Elongated magnet 90 permits placement of tool bit 80A shown as tool bit 80B at a second position 94 associated with south pole S to demagnetize tool bit 80A. Second position 94 is positioned at a predetermined distance D from elongated magnet 90. Elongated magnet 90 permits placement of a fastening device, in particular, Phillips screw 88, at a third position 96 on elongated magnet 90 associated with south pole S. Third position 96 is spaced from first position 92 and defines a holding area 98 on the surface of elongated magnet 90 that can accommodate screw head 86 in direct contact and so magnetize at least screw head 86 so as to hold screw 88 on the surface of elongated magnet 90 by magnetic force.

FIG. 5 show magnetizer/demagnetizer 68 including a holding or mounting area 98 that mounts elongated magnet 90. Holding area 98 is unitary with non-magnetizable housing 74, which is preferably made of a plastic material. Housing 74, in particular holding area 98, forms a first access cavity 100 associated with first position 92. Housing 74, in particular holding area 98, further provides a second access cavity 102 associated with second position 94 for demagnification of tool bit 80A shown as demagnetize tool bit 80B in particular bit tip 84B in a structure that will be further set forth. Holding area 98 also provides a third access cavity 104 associated with third position 96 for placement of a fastening device, in particular, screw 88 at third position 96 on elongated magnet 90 at a position associated with south pole S so that screw 88 is held by magnetic force to elongated magnet 90 and to magnetizer/demagnetizer 68 and thus to power driving tool 70 while a user carries power driving tool 70 to a work area. Third access cavity 104 is continuous with first access cavity 100.

Housing 74, in particular holding area 98, defines a rectangular elongated recess 105 having a open top in which is positioned elongated magnet 90 aligned with the longitudinal dimension of power driving tool 70. Tool bit 80A and in particular bit tip 84A is shown in FIG. 5 positioned in magnetizing contact and also shown in FIG. 6A being positioned for magnetizing contact with elongated magnet 90 at first position 92 in particular positioned in first access cavity 100 for contact with the N pole. Tool bit 80A, in particularly bit tip 84A, are magnetized by contact with elongated magnet 90 at first position 92. As shown in FIGS. 5 6A, and 6B, holding area 98 has a wall 106 separating elongated magnet 90 from first access cavity 100 at second position 94. Wall 106 has a thickness of a predetermined distance D at second position 94 so that tool bit 80B in particular bit tip 84B are demagnetized at second position 94 by touching bit tip 84 to wall 106. FIG. 6B shows tool bit 80B with bit tip 84B positioned in second access cavity 102 in preparation for demagnetizing contact with wall 106.

As shown in FIGS. 5 and 6A, screw 88 is magnetized by direct contact of screw head 86 with elongated magnet 90 at third position 96 in first access cavity 100 opening to elongated magnet 90 where screw head 86 of screw 88 is placed into direct magnetizing contact with elongated magnet 90.

Figure 7:
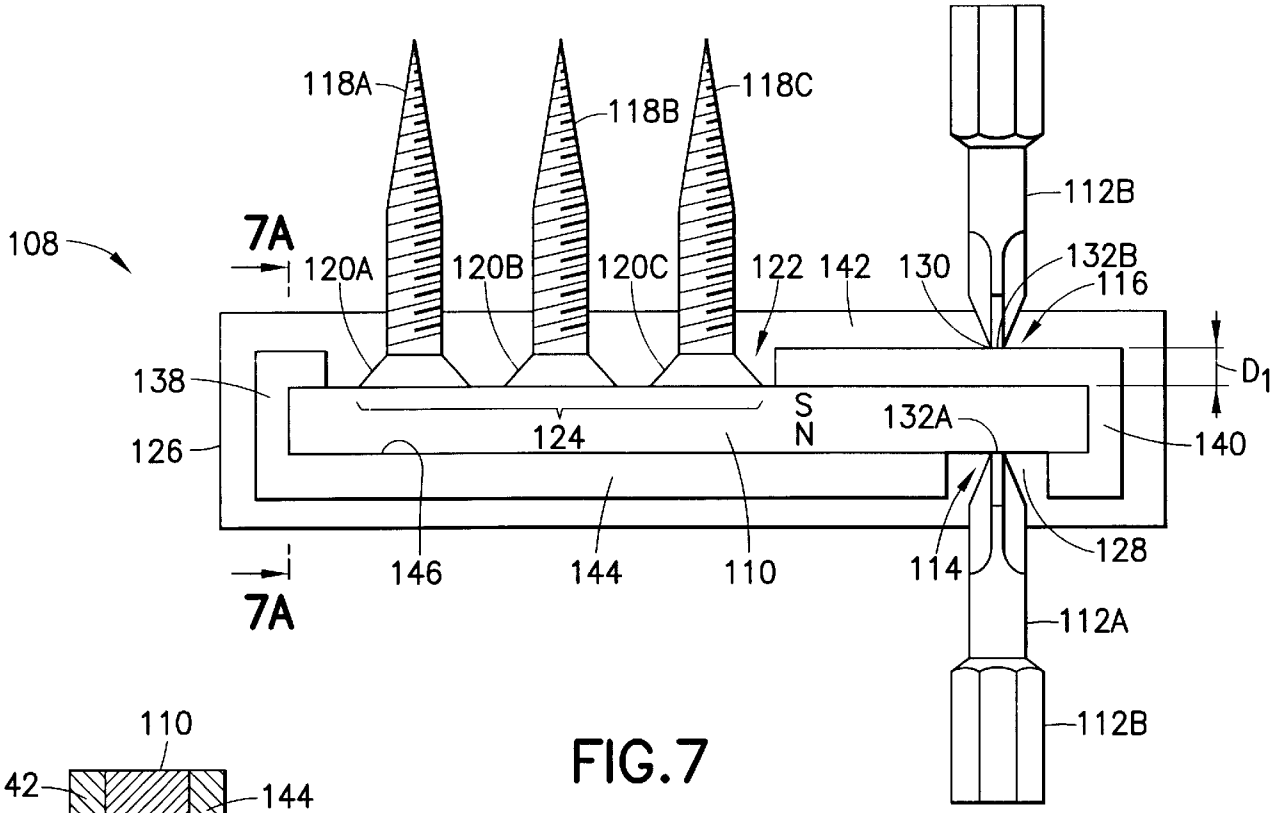
FIG. 7 is a top view of a magnetizer/demagnetizer unit analogous to the unit shown FIGS. 1, 2, 3, and 4 shown in isolation for attachment to a portable power screwdriver such as that shown in FIG. 1 showing a plurality of Phillips screws, shown as three, magnetically held at an extended holding area of the bar magnet of the magnetizer/demagnetizer unit; the magnetizing area of the magnetizer/demagnetizer and the Phillips driver screw bit alternatively positioned at the demagnetizing area of the magnetizer/demagnetized unit and further showing the relative magnetizing and demagnetizing distances from the bar magnet.

FIG. 7 shows another embodiment of the present invention as a magnetizer/demagnetizer 108 that includes an elongated magnet 110. A tool bit 112A is shown in magnetizing contact with the north pole N of elongated magnet 110 at a first position 114. The same tool bit indicated as tool bit 112B is also shown mounted at a second position 116 spaced from elongated magnet 110 at the south pole S at a position directly opposed to first position 114. Second position 116 is located at a distance D from elongated magnet 110 as will be discussed. A number of Phillips screws, shown as three Phillips screws 118A, 118B, and 118C for purposes of exposition having three screw heads 120A, 120B and 120C are shown mounted at a third position 122, which is also indicated at screw elongated holding surface by touching tool bit tip 28 of tool bit 22 on a planar surface of elongated magnet 110. Screws 118A–C are held on the surface of elongated magnet 110 by the force of magnetic attraction. Thus, a user can transport the screws along with the power driving tool in the same manner as screw 32 is transported along with power driving tool 12 of magnetizer/demagnetizer 10 previously described.

FIG. 7 shows magnetizer/demagnetizer 108 including a holding, or mounting, body 126 that mounts elongated magnet 110. Holding body 126 is made of a nonmagnetizable material such as plastic. Holding body 126 provides a first access, or aperture, 128 associated with first position 114. Holding body 126 further provides a second access 130 associated with second position 116 for demagnification of tool bit 112B in particular tool bit tip 132B in a manner that will be set forth. Holding body 126 also provides a third access, or aperture, 134 at third position 122 for placement of several fastening devices such as the three screws 118A–C at holding area 124 on elongated magnet 110 at south pole S so that screws 118A–C are held by magnetic force to elongated magnet 110 and to magnetizer/demagnetizer 108 and thus to the power driving tool while a user carries the power driving tool to a work area. In addition, after tool bit 112A particularly tool bit tip 132A has been magnetized at a north pole N, when the user removes one of the screws 118A–C from elongated magnet 110 and sets the selected screw at the work piece and then sets the magnetized tool bit 112A particularly magnetized tool bit tip 132A into the slots of the particular head of the selected screw 118A–C, selected magnetized screw of screws 118A–C is held to magnetized tool bit 112A by the force of magnetic attraction. After the completion of the work, namely, driving the screw into the work piece, there would be no necessity to demagnetize the magnetized screw. Demagnetization of tool bit 112A is accomplished at second position 116.

Holding body 126 includes a rectangular mounting base 136 and a pair of opposed parallel end walls 138 and 140 connected to mounting base 136 and a pair of opposed parallel side walls 142 and 144 connected to end walls 138 and 140 and to mounting base 136 to form a generally rectangular structure having a longitudinal dimension defined by parallel side walls 142 and 140. Rectangular mounting base 136 extends slightly beyond both end walls 138 and 140 and both side walls 142 and 144. Mounting base 136, end walls 138 and 140, and side walls 142 and 144 define an elongated rectangular recess 146 in which is positioned elongated magnet 110. Holding body 126 is elongated in the dimension of side walls 142 and 144 and elongated recess 146 that holds elongated magnet 110.

Side wall 144 forms first access aperture 128 to elongated magnet 110 at first position 114. Side wall 144 provides second access 116 by the thickness D of side wall 142. Side wall 142 has a thickness of the predetermined distance D at second position 116, so that tool bit tip 132B is demagnetized at second position 116 by touching bit tip 132B of tool bit 112B at second position 116. Thus, side wall 144 provides second access 16 to elongated magnet 110 at second position 116.

Figure 7A:
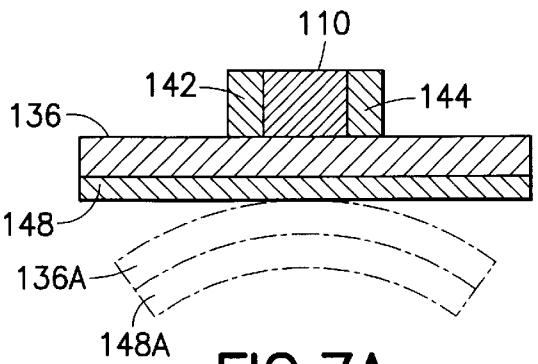
FIG. 7A is a view taken through line 7A—7A in FIG. 7.

As shown in FIG. 7A an adhesive bottom 148 of planar mounting base 136 can attach magnetizer/demagnetizer 108 to any flat surface of a power driving tool. Mounting base 136 is contoured to fit onto a curved non-operative portion of the housing of a power driving tool such a power driving tool 12 shown in FIGS. 1 and 2 at the top rear area of housing 14. FIG. 7A also shows an optional contoured arcuate mounting base 136A in phantom line that fits onto a curved housing of a power driving tool. Elongated concave arcuate mounting base 136A has the base of the concavity extending longitudinally midway between side walls 142 and 144 so that magnetizer/demagnetize 10 fits in the longitudinal direction on the curved surface of a power tool housing. A contoured flexible adhesive bottom side 148A also shown in phantom line is connected to contoured mounting base 136A for connecting holding body 126 to the non-operative portion of the housing of a power driving tool such as power driving tool 12 shown in FIGS. 1 and 2. Mounting base 136 can optionally be made of a flexible material such as plastic that can be contoured to fit onto a housing such as power tool housing 74 in a manner analogous to contoured mounting base 66. Adhesive bottom side 148 can likewise be made of a flexible material such as a rubber or plastic adhesive, that can be contoured with flexure of mounting base 136. A flexible mounting base 136 can be flexibly adjusted to fit onto a power tool housing either in the long dimension or the short dimension.

Figure 8:
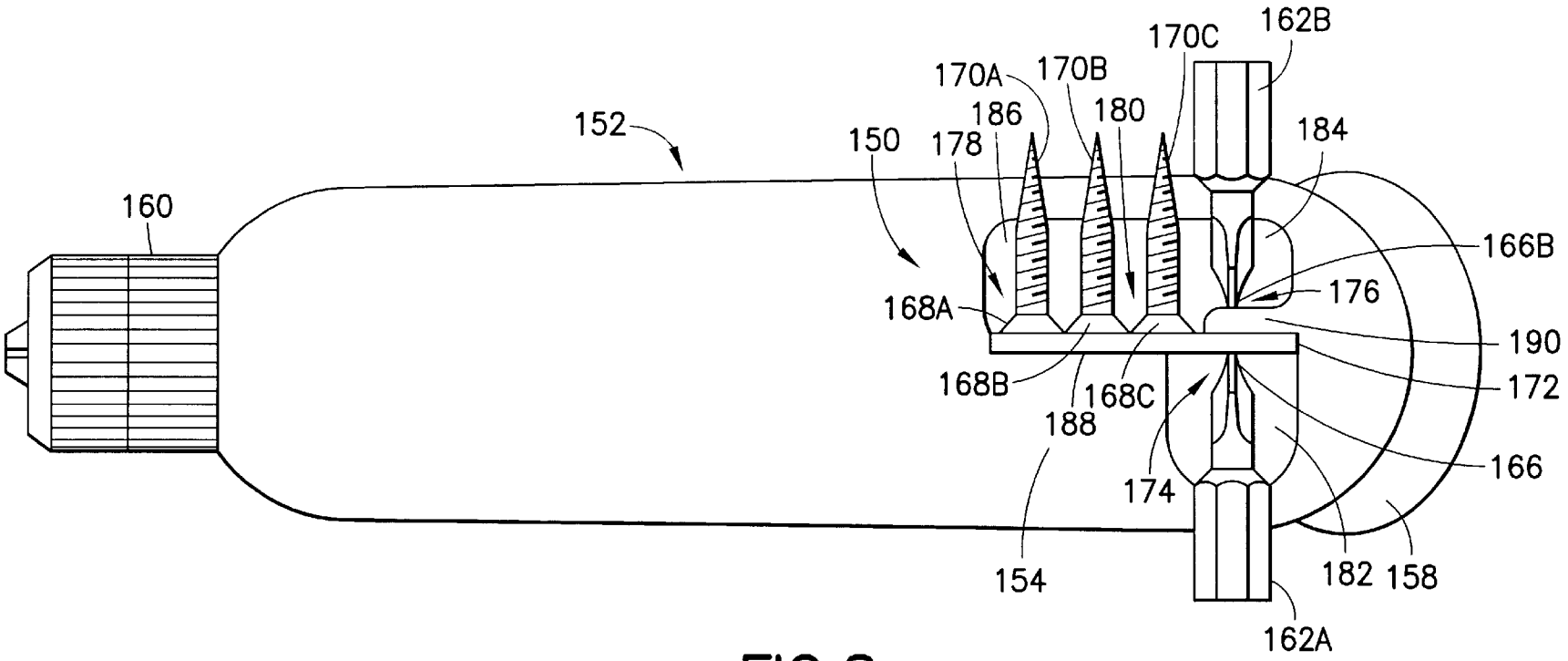
FIG. 8 is a top view of a portable power screwdriver illustrating a high energy magnetizer/demagnetizer unit analogous to the magnetizer/demagnetizer unit shown in FIG. 7 that is integral with a read portion of a Phillips power driving tool illustrating a Phillips driver screw bit positioned in the magnetizing portion of a bar magnet and further illustrating a plurality of Phillips head screws, shown as three, magnetically attached to the holding area of the magnetizer/demagnetizer unit.

FIG. 8 shows an alternate embodiment of the present invention where a magnetizer/demagnetizer 150 analogous to magnetizer/demagnetizer 68 shown in FIG. 5 is mounted integral with a Phillips power driving tool 152 at a non-operative portion 154 positioned at the top rear area of the power tool housing 156. Power driving tool 152 includes non-magnetizable housing 156, a handle 158, and a chuck 160. Non-operative rear housing portion 154 is located over handle 158. A magnetizable driver tool bit 162 includes a shank 164 and a tool bit tip 166, the latter including a screwdriver tip blade that mates with the crossed slots of the screw heads 168 of three Phillips screws 170.

As best shown in FIG. 8, tool bit 162 in particular tool bit tip 166 and three Phillips screw heads 168A, 168B, and 168C and three Phillips screws 170A, 170B, and 170C, are magnetized with opposite polarities so that any of the three screws 170A–C is magnetically held to driver tool bit 162 when in the work mode analogous to the work mode as shown in FIG. 1A.

As further shown in FIG. 8, a permanent high energy elongated bar magnet 172 that is shown for purposes of exposition only to be rectangular in configuration has a long dimension and a short dimension. The long dimension is shown for purposes of exposition to be aligned with the longitudinal dimension of power driving tool 152 from chuck 160 to non-operative housing portion 154. The short dimension of elongated magnet 172 has opposed north and south poles indicated as N and S, respectively, that are separated across the short dimension. The pole designations can be reversed for the purposes of this application.

Elongated magnet 172 permits a first position 174 associated with the north pole N to magnetize tool bit 162 particularly tool bit tip 166. Elongated magnet 172 permits placement of tool bit 162 particularly tool bit tip 166 at a second position 176 associated with south pole S to demagnetize tool bit 162. Second position 176 is positioned at a predetermined distance D from elongated magnet 172. Elongated magnet 172 also permits placement of several fastening devices, shown for purposes of exposition to be three Phillips screws 170A, 170B, and 170C at a third position 178 on elongated magnet 172 associated with south pole S. Third position 178 is spaced from first position 174 and defines a screw holding area 180 on the surface of elongated magnet 172 that can accommodate three Phillips screw heads 168A, 168B, and 168C in direct contact and so magnetize all three screw head 168A, 168B,and 168C so as to hold three screws 170A–C on the surface of elongated magnet 172 by magnetic force.

FIG. 8 shows a housing holding area 181 that mounts elongated magnet 172. Holding area 181 is unitary with non-magnetizable housing 156, which is preferably made of a plastic material. Housing 156, in particular housing holding area 181, forms a first access cavity 182 associated with first position 174. Housing 156, in particular housing holding area 181, further provides a second access cavity 184 associated with second position 176 for demagnification of tool bit 162 in particular bit tip 166 in a structure that will be further set forth. Housing holding area 181 also provides a third access cavity 186 associated with third position 178 for placement of screws 170A–C at third position 178 on elongated magnet 172 at south pole S, so that screws 170A–C are held by magnetic force to elongated magnet 172 and to magnetizer/demagnetizer 150 and thus to power driving tool 152 while a user carries power driving tool 152 to a work area. Third access cavity 186 is continuous with first access cavity 182.

Housing 156, in particular housing holding area 181, defines a rectangular elongated recess 188 having a open top in which is positioned elongated magnet 172 aligned with the longitudinal dimension of power driving tool 152. Tool bit 162 and in particular tool bit tip 166 is shown in FIG. 8 positioned in magnetizing contact with elongated magnet 172 at first position 174 and in particular positioned in first access cavity 182 for contact with the N pole. Housing holding area 181 has a wall 190 separating elongated magnet 172 from first access cavity 182 at second position 176. Wall 190 has a thickness of a predetermined distance D at second position 176 so that tool bit 162 in particular bit tip 166 are demagnetized at second position 176 by placing bit tip 162 at wall 190. FIG. 8 shows tool bit 162 with bit tip 162 positioned in second access cavity 184 in preparation for demagnetizing at wall 180.

Figure 10:
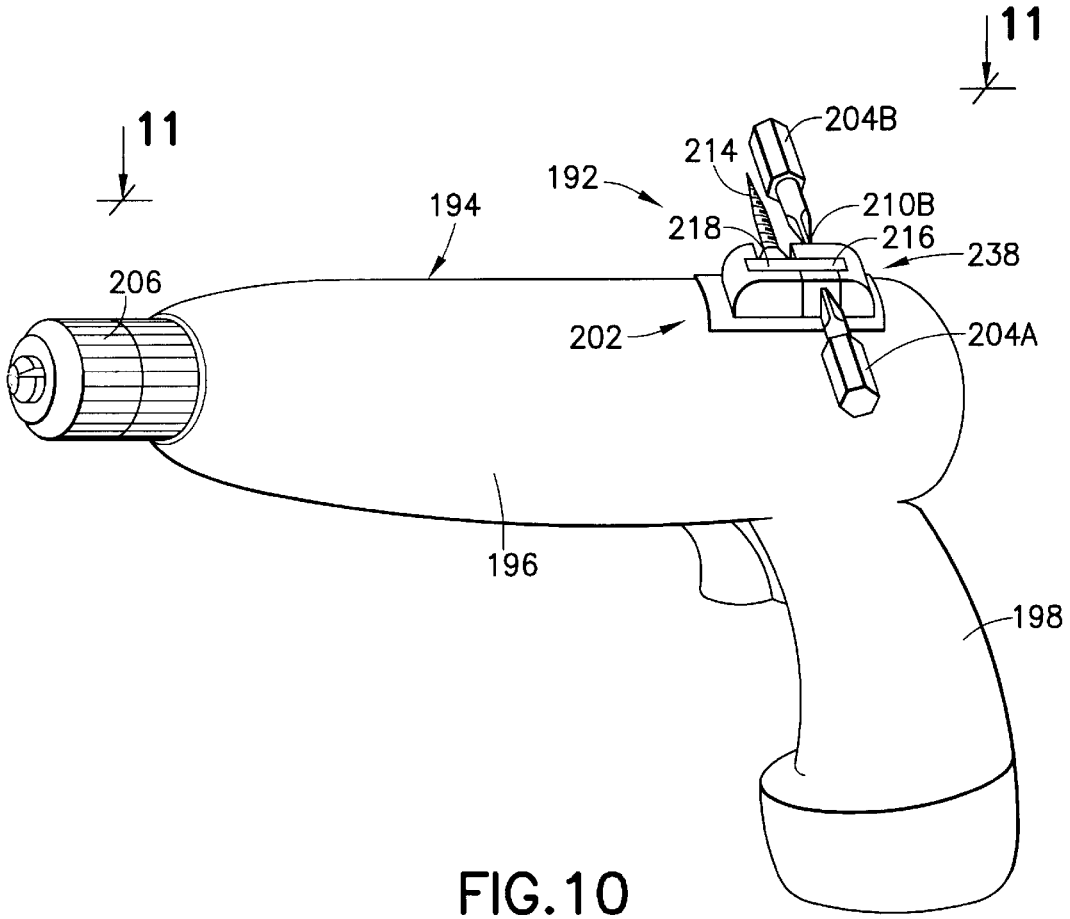
FIG. 10 is a perspective view of a portable power driver illustrating a high energy magnetizer/demagnetizer unit that includes an elongated super magnet/shunt magnet including a super magnet/shunt magnet attached to the surface of the rear portion of the power driver housing and also illustrating a Phillips driver screw bit positioned in the super magnet magnetizing portion of the super magnet/shunt magnetizer/demagnetizer shown in FIG. 9B, the same Phillips screw bit being alternatively positioned in the demagnetizing portion of the super magnet/shunt magnetizer/demagnetizer, and further illustrating a Phillips head screw magnetically attached to a holding area of the super magnet/shunt magnetizer/demagnetizer.
Figure 11:
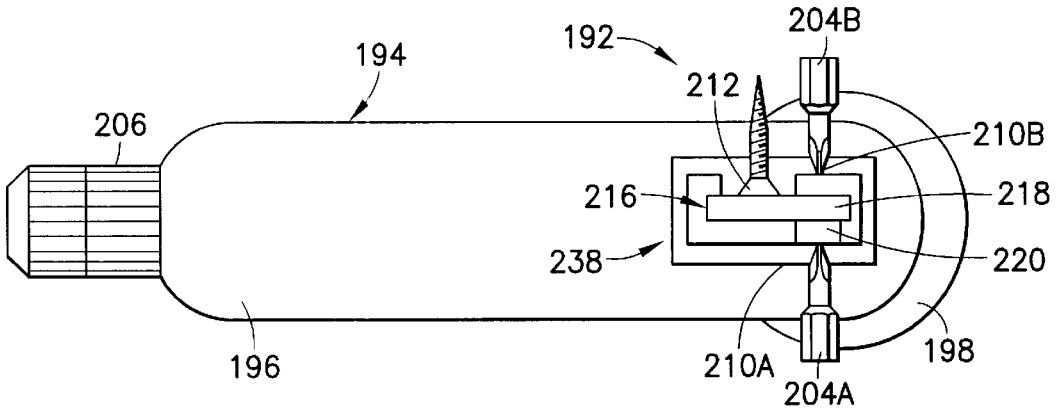
FIG. 11 is a view taken through plane 11—11 of FIG. 10.

Another embodiment of the present invention is shown in FIGS. 10 and 11 that show a high energy magnetizer/demagnetizer 192 is attached to a portable power driving tool 194, which is shown for purposes of exposition as a power driving tool. Power driving tool 194 includes a non-magnetizable housing 196, a handle 198, and a chuck 200. Magnetizer/demagnetizer 192 is mounted to a non-operative portion 202 of housing 196, which is shown for purposes of exposition as the upper rear area of housing 196. A magnetized driver tool bit 204A is secured to chuck 206 in the manner shown in FIG. 1A for driving the head of a fastening device into a work piece. Driver tool bit 204A includes a shank 208 and a tool bit tip 210 which includes a screwdriver tip blade that is shown mating with the crossed slots of the screw head 212 of a Phillips screw 214. Tool bit 204A and Phillips screw 214, in particular tool bit tip 210A and screw head 212, are magnetized with opposite polarities so that the entire screw 214 can magnetically held to tool bit 204A during work activity.

Figure 9A:
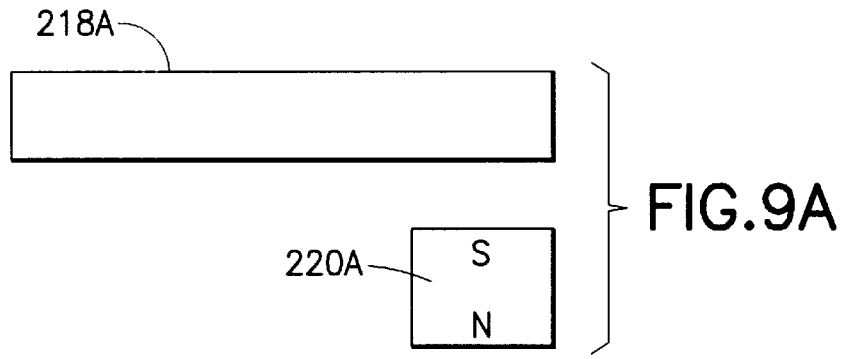
FIG. 9A is a super magnet in position to be attached to an elongated magnetizable metal shunt.
Figure 9B:
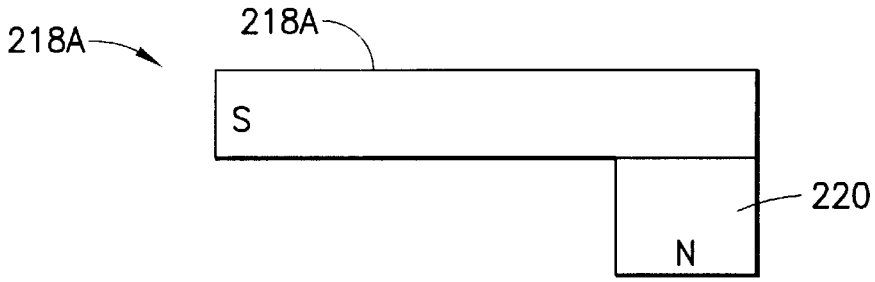
FIG. 9B is the single super magnet and shunt shown in FIG. 9A having been connected together to form a single elongated super magnet/shunt magnet.
Figure 9C:
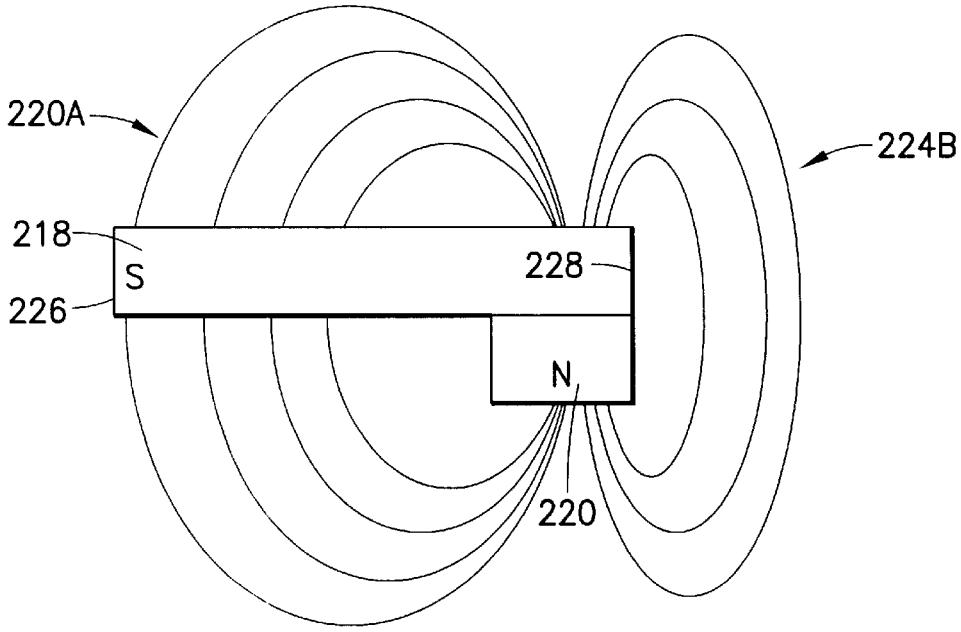
FIG. 9C is the single super magnet/shunt magnet shown in FIG. 9B further showing the pole orientation and the lines of flux.

As shown in FIGS. 10, 11, 12, and 13, a permanent high energy elongated magnet 216 comprises an elongated shunt portion 218 and a small high energy super magnet, or pill magnet. Details of elongated magnet 216 are shown in FIGS. 9A, 9B, and 9C. FIG. 9A shows a preliminary structure of elongated magnet 216 with super magnet 220A shown in isolation in preparation for being joined to an elongated demagnetized shunt 218A, which is made of a magnetizable material such as a metal such as steel. Super magnet 220A is shown with a north pole N and a south pole S with south pole S in proximity to one end of demagnetized shunt 218A. Demagnetized shunt 218A is elongated and further shown as rectangular in configuration having opposed planar surfaces. FIG. 9B shows south pole S of super magnet 220A having been attached in a manner known in the art to one end of shunt 218A so as to create unitary elongated magnet 216 as described. As shown in FIG. 9B, upon magnetization of shunt portion 218, south pole S is created at the distal end 224 of shunt portion 218 relative to super magnet portion 220 while at the same time north pole N of elongated magnet 216 remains at the same position at super magnet portion 220 as it was in the isolated super magnet 220A as shown in FIG. 9B. FIG. 9C shows elongated magnet 216 as seen in FIG. 9B with opposed lines of flux 222A and 222B between north pole N and south pole S. Flux lines 222A are configured around the proximal end of elongated magnet 216 between north pole N at the exposed surface super magnet portion 220 and the opposed exposed side of the proximal end of shunt portion 218 relative to super magnet portion 220 with the result that proximal end 228 of shunt portion 218 opposed to super magnet portion 220 is in actual effect a form of a south pole of north pole N but of lesser strength than the actual north pole N at distal end 224 of shunt portion 226. Actual south pole S at distal end 224 of shunt portion 218 is of equal magnetic strength as north pole N at super magnet portion 220. The north and south polarities indicated in FIGS. 9A, 9B, and 9C are shown for purposes of exposition only and can be reversed within-the spirit of the invention.

Figure 13:
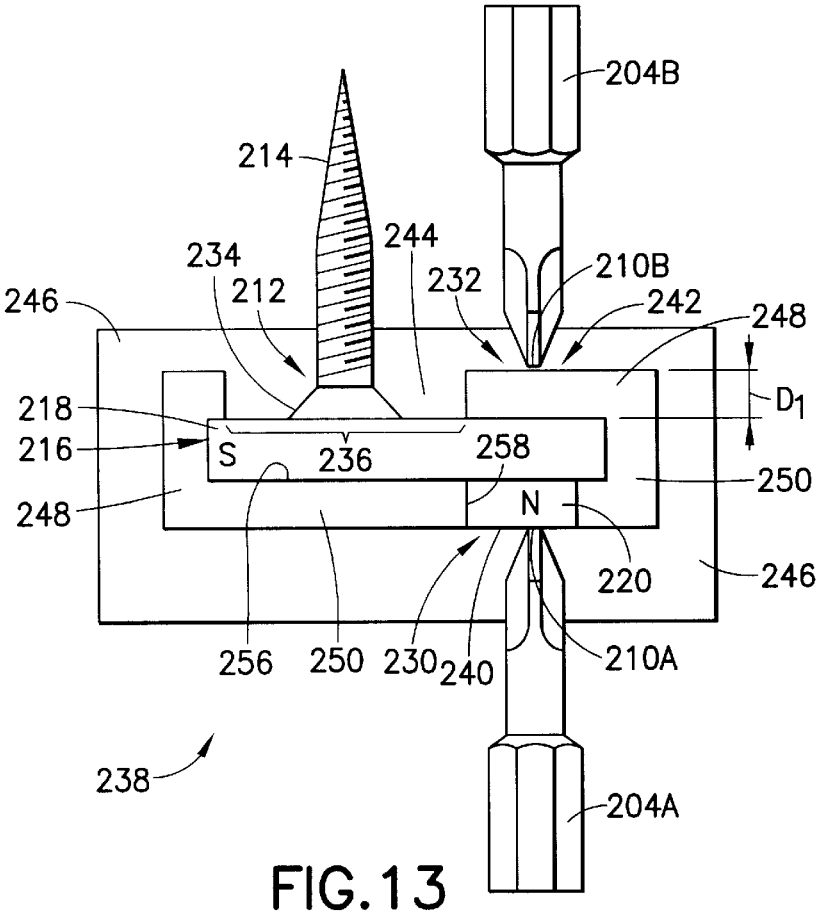
FIG. 13 is a top view taken through plane 13—13 of FIG. 15.

Elongated magnet 216 is of such length, or of longitudinal dimension, that placement of tool bit 204A is permitted on elongated magnet 216 at a first position 230 associated with the north pole N at super magnet portion 220 to magnetize tool bit 204A in particular tool bit tip 210. Elongated magnet 216 permits placement of tool bit 204A in particular tool bit tip 204A at a second position associated with proximal end 228 of shunt portion 218 for demagnetization as shown as tool bit 204B and tool bit tip 204B. As noted earlier, proximal end 228 in fact has a south pole characteristic that acts to demagnetize the north pole magnetic aspect of tool bit 204B. As best seen in FIG. 13, second position 232 is positioned at a predetermined distance $D_1$ from elongated magnet 216 in particular from proximal end 228 of shunt portion 218 as will be discussed in detail.

As shown in FIGS. 10, 11, 12, and 13, elongated magnet 216 permits placement of a fastening device, in particular, Phillips screw 214, at a third position 234 on elongated magnet 216 associated with south pole S of elongated magnet 216, in particular, distal end 226 of shunt portion 218. Third position 234 is spaced from first and second positions 230 and 232 and defines a screw holding area 236 on the planar surface of elongated magnet 216 that can accommodate screw head in direct contact thereto and so magnetize at least screw head 212 and thus hold screw 214 on the surface of elongated magnet 216.

Figure 12:
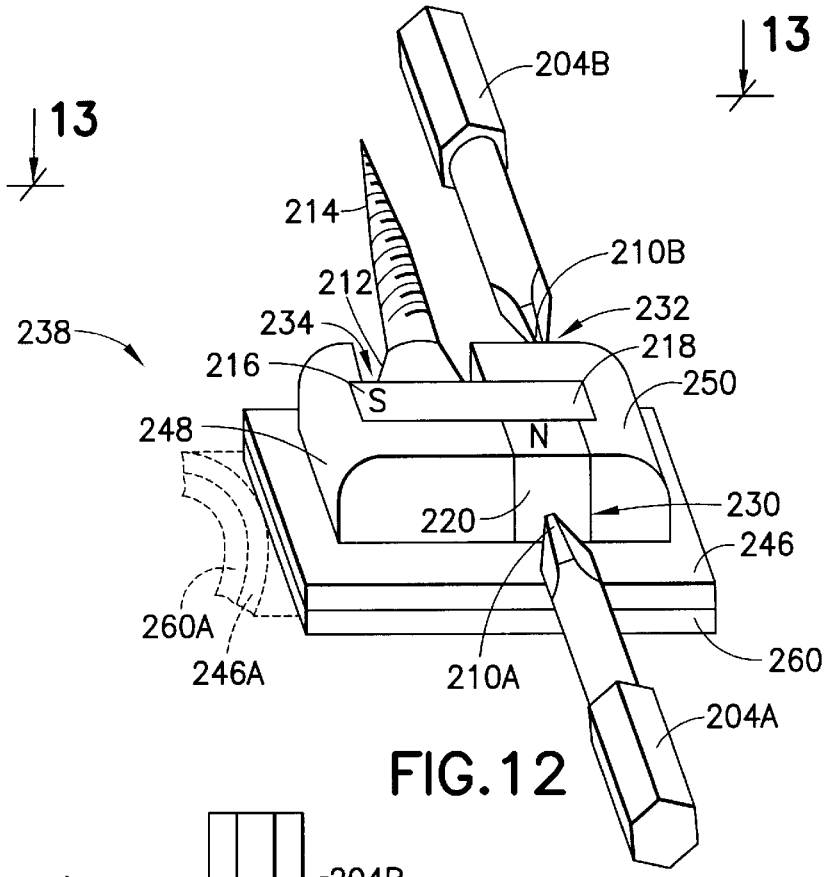
FIG. 12 is a perspective view of the elongated super magnet/shunt magnetizer/demagnetizer similar to the unit shown FIGS. 10 and 11 shown in isolation having a flat mounting surface and also showing in phantom line an arcuate mounting surface for attachment to a curved surface such as the curved surface of the driver housing shown in FIG. 10 and further showing the Phillips driver bit positioned at the super magnet magnetizing portion and also at the demagnetizing portion and also showing the Phillips screw magnetically held at the holding area of the super magnet/shunt magnetizer/demagnetizer and further showing the relative magnetizing demagnetizing distances from the magnetizer/demagnetizer.

FIGS. 12 and 13 show magnetizer demagnetizer 192 including a housing holding, or mounting, body 238 that mounts elongated magnet 216. Holding body 238 is made of a non-magnetizable material such as plastic. Holding body 238 provides a first access 240 associated with first position 230. Holding body 238 further provides a second access 242 associated with second position 232 for demagnification of tool bit 204A in particular tool bit tip 210A and indicated as demagnetized tool bit 204B and tool bit tip 210B in a manner that will be further set forth. Holding body 238 also provides a third access, or access aperture, 244 associated with third position 234 for placement of a fastening device, in particular, screw 214 at third position 234 on elongated magnet 216 associated with south pole S, in particular on shunt portion 218 at distal end 226 so that screw 214 is held by magnetic force to elongated magnet 216 and to magnetizer/demagnetizer 192 and thus to power driving tool 194 while a user carries power driving tool 194 to a desired work area.

In addition, after tool bit 204A, particularly tool bit tip 210A have been magnetized at a north pole N, and when the user removes screw 214 from elongated magnet 216 and sets screw 214 at the work piece and then sets the magnetized tool bit 204A particularly magnetized tool bit tip 210A into the crossed slots of magnetized Phillips screw 214, magnetized screw 214 is held to magnetized tool bit 204A by the force of magnetic attraction. After driving screw 214 into the work piece, there would ordinarily be no necessity to demagnetize magnetized screw 214. Demagnetization of tool bit 204A is accomplished at second position 232.

Holding body 238 includes a mounting base 246 and a pair of opposed parallel end walls 248 and 250 connected to mounting base 246 and a pair of opposed parallel elongated side walls 252 and 254 connected to end walls 248 and 250 and to mounting base 246 to form a generally rectangular structure having a longitudinal dimension defined by parallel side walls 252 and 254. Rectangular mounting base 246 extends slightly beyond both end walls 248 and 250 and both side walls 252 and 254. Mounting base 246, end walls 248 and 250, and side walls 252 and 254 define an elongated rectangular recess 256 in which is positioned shunt portion 218 of elongated magnet 216. Side wall 254 forms a subrecess 258 in which is positioned super magnet portion 220 so that super magnet portion 220 has an exposed planar surface at first access 240 that defines first position 230.

Tool bit 204A is shown in FIGS. 10,11, 12, and 13 positioned in magnetizing contact with elongated magnet 216 at first position 230 in particular positioned at first access 240 so that in particular bit tip 210 is magnetized. Screw 214 is magnetized by direct contact of screw head 212 with elongated magnet 216 at third position 234. Side wall 254 further forms third access, or access aperture, 244 to elongated magnet 216 at third position 234 where screw head 212 is placed into direct magnetizing contact with and magnetically held by elongated magnet 216.

Side wall 252 has the thickness of the predetermined distance $D_1$, at second position 232, so that tool bit 204A particularly bit tip 210A are demagnetized at second position 232 by placing tool bit tip 210 to side wall 252. Thus, side wall 252 provides second access 242 to elongated magnet 216 at second position 232.

An adhesive bottom side 260 of planar mounting base 246 shown in FIG. 12 can attach magnetizer/demagnetizer 192 to any surface, preferably a planar surface, of a non-operational portion of a power driving tool. An alternative mounting base 246A shown in FIG. 12 is contoured to fit onto an arcuate non-operative portion of the housing 196 of a power driving tool such as power driving tool 194 shown in FIGS. 10 and 11. Elongated concave arcuate mounting base 246A has the base of the concavity extending longitudinally midway between side walls 252 and 254 so that magnetizer/ demagnetizer192 fits in the longitudinal direction on a curved surface of a power tool housing. Contoured adhesive bottom side 260A also shown in phantom line is connected to contoured mounting base 246A for connecting holding body 238 to a non-operative portion of the housing of a power driving tool. Mounting base 246 can be made of a flexible material such as plastic that can be contoured to fit onto onto a housing such as power tool housing 196 in a manner analogous to contoured mounting base 246A. Adhesive bottom side 260 can likewise be made of a flexible material that can be contoured along with a flexible mounting base 246. Flexible mounting base 246 can be flexibly adjusted to fit onto the desired location on a power tool housing.

Figure 14:
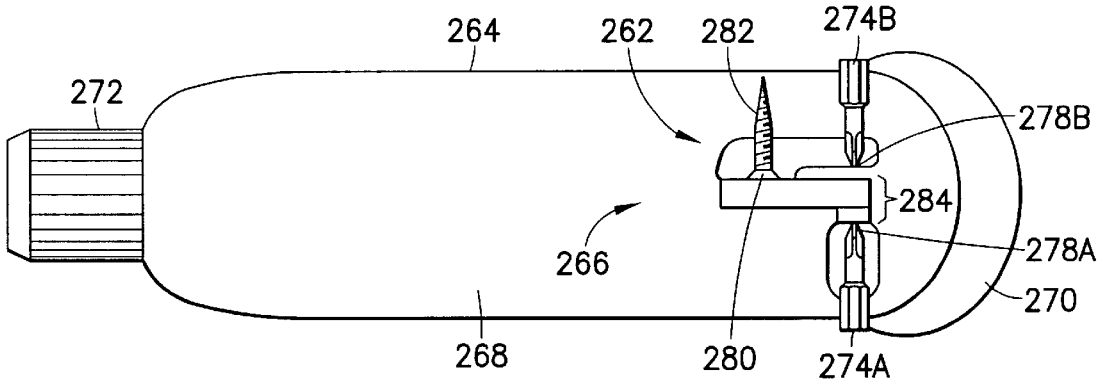
FIG. 14 is a top view of a portable power screwdriver illustrating a high energy magnetizer/demagnetizer unit including a single super magnet/shunt magnet of the having analogous features of the magnetizer/demagnetizer 192 shown in FIG. 14 that is integral with a rear portion of the power driver housing and also illustrating a Phillips driver screw bit positioned in the super magnet magnetizing portion of the super magnet/shunt magnet and also positioned in the demagnetizing portion of the super magnet/shunt magnet and further illustrating a Phillips head screw magnetically attached to the holding area of the magnetizer/demagnetizer unit.
Figure 15:
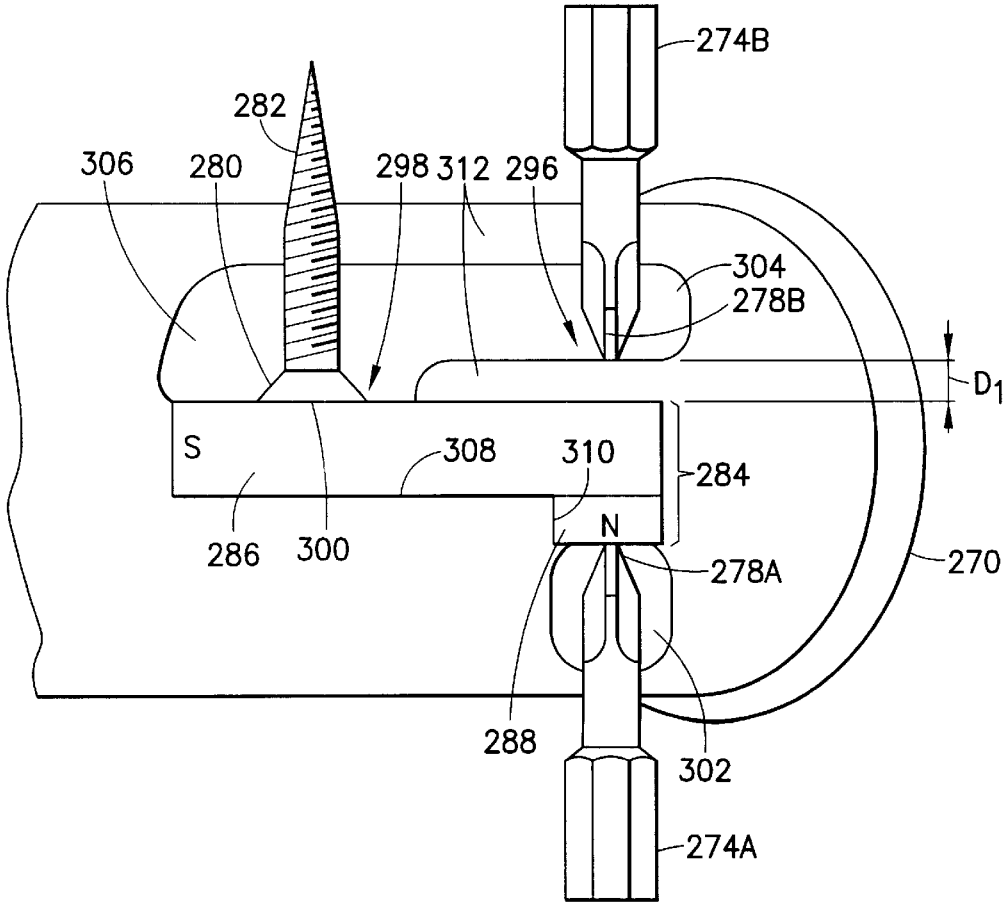
FIG. 15 is a broken away enlarged top view of the magnetizer/demagnetizer unit shown in FIG. 14.

FIGS. 14 and 15 show an alternate embodiment of the present invention where a magnetizer/demagnetizer 262 analogous to magnetizer/demagnetizer 192 is mounted integral with a power driving tool shown as power driving tool 264 for purposes of exposition at a non-operative portion 266 positioned at the top rear area of the power tool housing 268. Power driving tool 264 includes a non-magnetizable housing 268, a handle 270, and a chuck 272. Non-operative portion 266 is located over handle 270. A magnetizable driver tool bit 274A includes a tool bit tip 278A, the latter including a screwdriver tip blade that mates with the crossed slots of the Phillips screw head 282 of a Phillips screw 282. As shown in FIGS. 14 and 15, tool bit 274A with tool bit tip 274A are being magnetized. Phillips screw 282 and in particular Phillips screw head 280 are being magnetically held to magnetizer/demagnetizer 192 and in addition is being magnetized with an opposite polarity from tool bit 274A so that the entire Phillips screw 282 is later magnetically held to tool bit 274A. In addition, FIGS. 14 and 15 show tool bit tip 278 along with the entire tool bit 274B being demagnetized in contact with magnetizer/ demagnetizer 192.

As further shown in FIGS. 14 and 15, a permanent high energy elongated magnet 284 that comprises an elongated shunt portion 286 and a super magnet, or pill magnet, portion 288 that has been attached to the proximal end 290 of shunt portion 286. Super magnet portion 288 has a north pole N and shunt portion 286 has a south pole S located at the distal end 292. Elongated magnet 284 has the same features and is constructed and arranged as elongated magnet 216 shown in FIG. 9B. Shunt portion 286 is shown for purposes of exposition only to be rectangular in configuration has a long dimension and a short dimension. The long dimension is shown for purposes of exposition to be aligned with the longitudinal dimension of power driving tool 264 in accord with the plane from chuck 272 to non-operative portion 266. The pole designations of elongated magnet 284 can be reversed for the purposes of the present invention.

Elongated magnet 284 permits a first position 294 associated with the north pole N at super magnet portion 288 to magnetize tool bit 274*a* and tool bit tip 278A in particular. Elongated magnet 284 permits placement of tool bit 274B and tool bit tip 278B in particular at a second position 296 associated with proximal end 290 of shunt portion 286 to demagnetize tool bit 274A and in particular tool bit tip 278A there shown as tool bit 274B and tool bit it 278B. Second position 296 is positioned at a predetermined distance $D_1$ from elongated magnet 284 and in particular from proximal end 290 of shunt portion 286. Elongated magnet 284 permits placement of a fastening device, in particular, Phillips screw 282, at a third position 298 on elongated magnet 264 associated with south pole S. Third position 298 is spaced from first position 294 and defines a screw holding area 300 on the side planar surface of elongated magnet 264 in particular on the surface of shunt portion 286 that can accommodate Phillips screw head 280 in direct contact and so magnetize at least screw head 280 so as to hold Phillips screw 282 on the surface of elongated magnet 284 by magnetic force.

FIGS. 14 and 15 also show magnetizer/demagnetizer 262 including a housing holding area 300 that mounts elongated magnet 284. Screw holding area 300 is unitary with nonmagnetizable housing 268, which is preferably made of a plastic material. Housing 268, in particular screw holding area 300, forms a first access that is shown as first access cavity 302 associated with first position 294. Housing 268, in particular holding area 300, further provides a second access that is shown as second access cavity 304 associated with second position 296 for demagnification of tool bit 274 in particular tool bit tip 278 in accordance with a structure that will be further set forth. Housing holding area 300 also provides a third access that is shown to be a third cavity access cavity 306 associated with third position 298 for placement of a fastening device, in particular, Phillips screw 282 at third position 298 on elongated magnet 284 in association with south pole S so that screw 282 is held by magnetic force to elongated magnet 284 and to magnetizer/demagnetizer 262 and thus to power driving tool 264 while a user carries power driving tool 264 to a work area. Third access cavity 306 and second access cavity 304 together define one continuous cavity.

Housing 268, in particular housing holding area 300, defines an elongated recess 308 having a open top in which is positioned elongated magnet 284 aligned with the longitudinal dimension of power driving tool 264. Housing holding area 300 defines an elongated rectangular recess 308 in which is positioned shunt portion 286 of elongated magnet 284. Housing holding area 300 forms a subrecess 310 opening to recess 308 in which is positioned super magnet portion 288. Super magnet portion 288 has an exposed planar surface at first access cavity 302 that defines first position 294.

Housing holding area 300 forms a wall 312 having a thickness of the predetermined distance $D_1$ at second position 296, so that tool bit 274B with bit tip 278B are demagnetized at second position 296 by touching bit tip 278. Thus, housing holding area 300 provides second position 296 to elongated magnet 284.

Tool bit 274A and in particular tool bit tip 278A are shown in FIGS. 14 and 15 positioned in magnetizing contact with elongated magnet 284 at first position 294 in particular positioned in first access cavity 302 for contact with the N pole. Tool bit 274A, in particular bit tip 278A, are magnetized by contact with elongated magnet 284 at first position 294. Wall 312 has a thickness of a predetermined distance $D_1$ at second position 296 so that tool bit 274B in particular bit tip 278B have been demagnetized at second position 296 by touching bit tip 278A to wall 312. FIGS. 14 and 15 show tool bit 274B with bit tip 278B positioned in second access cavity 304 in demagnetizing contact with wall 312.

As shown in FIGS. 14 and 15, Phillips screw 282 is magnetized by direct contact of screw head 280 with elongated magnet 284 at third position 298 in third access cavity 306 opening to elongated magnet 284 where screw head 280 of Phillips screw 282 is placed into direct magnetizing contact with elongated magnet 284 so that Phillips screw 282 is held in place to magnetizer/demagnetizer 262 in association with south pole S.

The user then carries power driving tool 264 with Phillips screw 282 to the work area at which time the user removes Phillips screw 282 from elongated magnet 284 and sets Phillips screw 282 at the work piece and then positions magnetized tool bit 274A particularly magnetized tool bit tip 278A into the crosses slots of magnetized Phillips screw 282, which is then held to magnetized tool bit 274 by the force of magnetic attraction. After the completion of the work, namely, driving Phillips screw 282 into the work piece, there would be no necessity to demagnetize magnetized Phillips screw 282. Demagnetization of tool bit 274B and tool bit tip 278B has been accomplished by placement of tool bit 274A at second position 296 as has been described.

Figure 16:
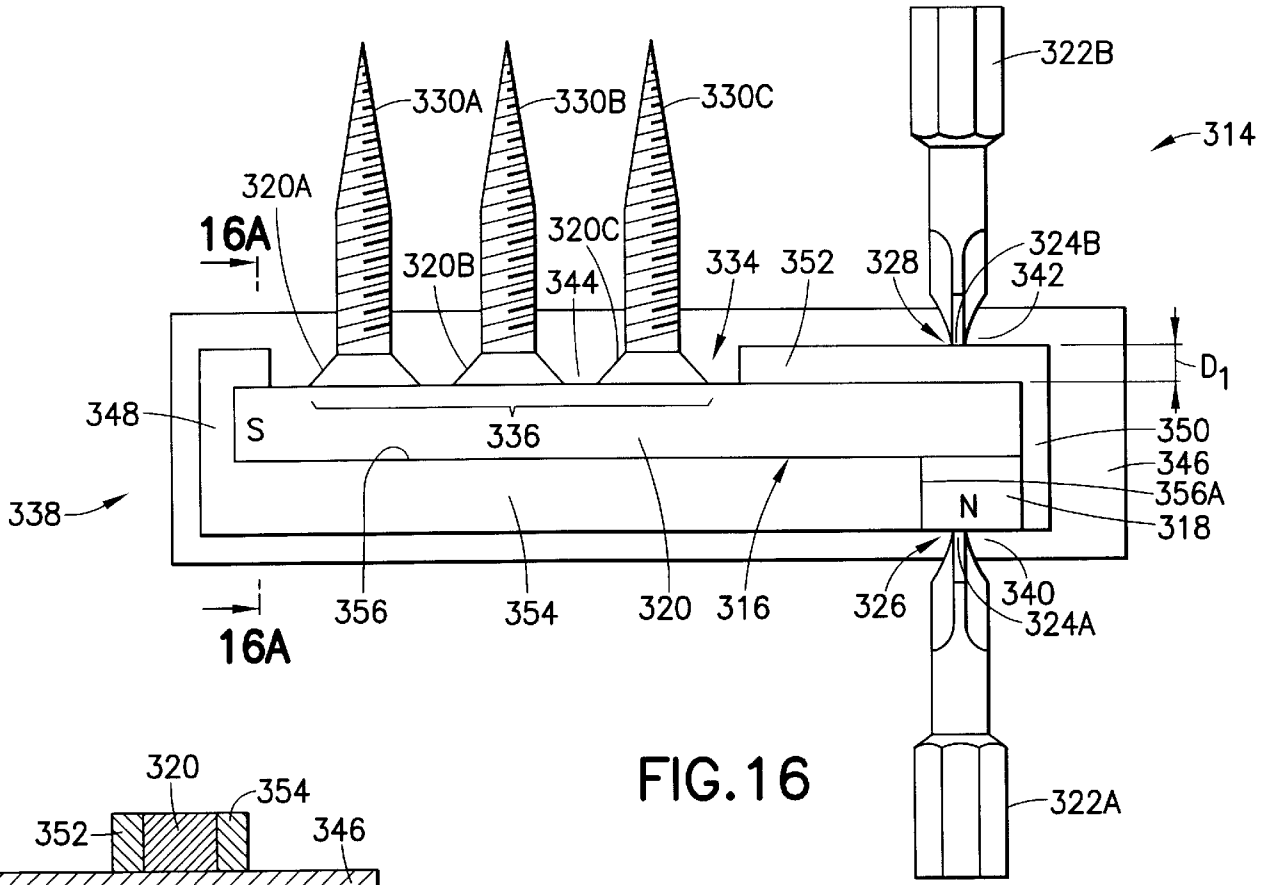
FIG. 16 is a top view of a super magnet/shunt magnetizer/demagnetizer unit shown in isolation for attachment to a portable power screwdriver showing three Phillips screws magnetically held at an extended holding area of the magnetizer/demagnetizer unit and further showing a Phillips driver screw bit positioned at the magnetizing area of the magnetizer/demagnetizer and the Phillips driver screw bit alternatively positioned at the demagnetizing area of the magnetizer/demagnetized unit and further showing the demagnetizing distance from the elongated magnet.

FIG. 16 shows another embodiment of the present invention as a magnetizer/demagnetizer 314 in isolation for attachment to a non-operational portion of a power driving tool such as Phillips power driving tool 264. Magnetizer/demagnetizer 314 includes an elongated magnet 316 comprising a super magnet portion 318 connected to the proximal end of an elongated shunt portion 320. A tool bit 322A has a tool bit tip 324A in magnetizing contact with the north pole N of elongated magnet 316 specifically at the north pole N at a first position 326. The same tool bit 322B has a tool bit tip 324B mounted in demagnetizing relationship to elongated magnet 316 at a second position 328 associated with the proximal end of shunt portion 320 directly opposed to first position 326. Second position 328 is located at a distance $D_1$ from elongated magnet 316 specifically from shunt portion 320 as will be discussed. A number of screws, indicated as Phillips screws for purposes of exposition, and further as three Phillips screws 330A, 330B, and 330C again for purposes of exposition that have three screw heads 332A, 332B, and 332C, respectively, are shown mounted in magnetic contact with elongated magnet 316 at a third position 334. Elongated magnet 316 defines a screw holding area 336 along a planar surface of elongated magnet 316 that accommodates screw heads 332A–C in direct magnetic contact and so magnetizes screw heads 332A–C and thus holds screws 330A–C on the surface of elongated magnet 316 by the force of magnetic attraction. Third position 334 is spaced from north pole N and is associated with south pole S. Thus, a user can transport the magnetically held three screws along with the power driving tool in the same manner as screw 214 is transported along with power driving tool 194 of magnetizer/demagnetizer 192 as previously described.

Magnetizer/demagnetizer 316 includes a holding body 338 that mounts elongated magnet 336. Holding body 338 is made of a non-magnetizable material such as plastic. Holding body 338 provides a first access 340 that is an aperture associated with first position 326 for magnetization of tool bit 322A. Holding body 338 further provides a second access 342 associated with second position 328 for demagnification of tool bit 322A in particular tool bit tip 324 in a manner that will be set forth. Holding body 338 also provides a third access, or aperture, 344 associated with third position 334 for placement of several fastening devices such as the three screws 330A–C at third position 334 on elongated magnet 316 at south pole S so that screws 330A–C are held magnetic force to elongated magnet 316 and to magnetizer/demagnetizer 314 and thus to the power driving tool while a user carries the power driving tool to a work area. In addition, after tool bit 322A particularly tool bit tip 324A has been magnetized at a north pole N, and after the user removes one of the screws 330A–C from elongated magnet 316 and sets the selected screw at the work piece and then sets the magnetized tool bit 322A particularly magnetized tool bit tip 324A into the slots of the particular head of the selected screw of screws 330A–C, the selected magnetized screw is held to magnetized tool bit 324A by the force of magnetic attraction. After driving the screw into the workpiece, there would be no necessity to demagnetize the magnetized screw. Demagnetization of tool bit 324A is accomplished at second position 328.

Holding body 338 includes a mounting base 346 and a pair of opposed parallel end walls 348 and 350 connected to mounting base 346 and a pair of opposed parallel side walls 352 and 354 connected to end walls 348 and 350 and to mounting base 346 to form a generally rectangular structure having a longitudinal dimension defined by parallel side walls 352 and 354. Rectangular mounting base 346 extends slightly beyond both end walls 348 and 350 and both side walls 352 and 354. Mounting base 346, end walls 348 and 350, and side walls 352 and 354 define a recess 356 in which is positioned elongated magnet 316. Holding body 338 is elongated in the dimension of side walls 352 and 354 and elongated recess 356 that holds elongated magnet 316. Side wall 354 defines a subrecess 356A in which is positioned super magnet portion 318.

Side wall 354 forms first access cavity 340 to elongated magnet 316 at first position 326 and side wall 354 provides second access 342. Side wall 352 has a thickness of the predetermined distance $D_1$ at second position 328, so that tool bit 324B with bit tip 324B are demagnetized at second position 328 by touching bit tip 324B of tool bit 322B at second position 328. Thus, side wall 352 provides second access 342 to elongated magnet 316 at second position 328.

Figure 16A:
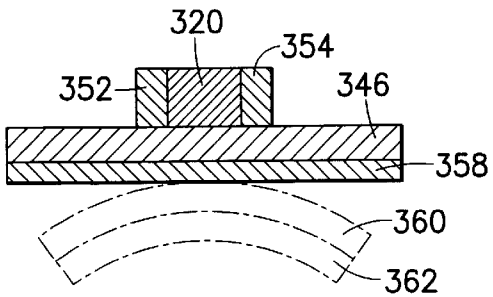
FIG. 16A is a side view taken through line 16A—16A of FIG. 16.

As shown in FIG. 16A an adhesive bottom side 358 of planar mounting base 346 can attach magnetizer/demagnetizer 314 to any flat surface of a power driving tool. Mounting base 346 is contoured to fit onto a curved non-operative portion of the housing of a power driving tool such as non-operating portion 266 of power driving tool 264 shown in FIGS. 14 and 15 at the top rear area of housing 268. FIG. 16A also shows an optional contoured arcuate mounting base 360 in phantom line that fits onto a curved housing of a power driving tool. Elongated concave arcuate mounting base 360A has the base of the concavity extending longitudinally midway between side walls 352 and 354 so that magnetizer/demagnetizer 262 fits in the longitudinal direction on the curved surface of a power tool housing. A contoured adhesive bottom side 362A also shown in phantom line is connected to contoured mounting base 362A for connecting holding body 338 to the nonoperative portion of the housing of a power driving tool such as power driving tool 264. Mounting base 346 can optionally be made of a flexible material such as plastic that can be contoured to fit onto onto a housing such as power tool housing 268 in a manner analogous to contoured mounting base 360. Adhesive bottom side 358 can likewise be made of a flexible material that can be contoured along with a flexible mounting base 346. A flexible mounting base 346 can be flexibly adjusted to fit onto a power tool housing either in the long dimension or the short dimension.

Figure 17:
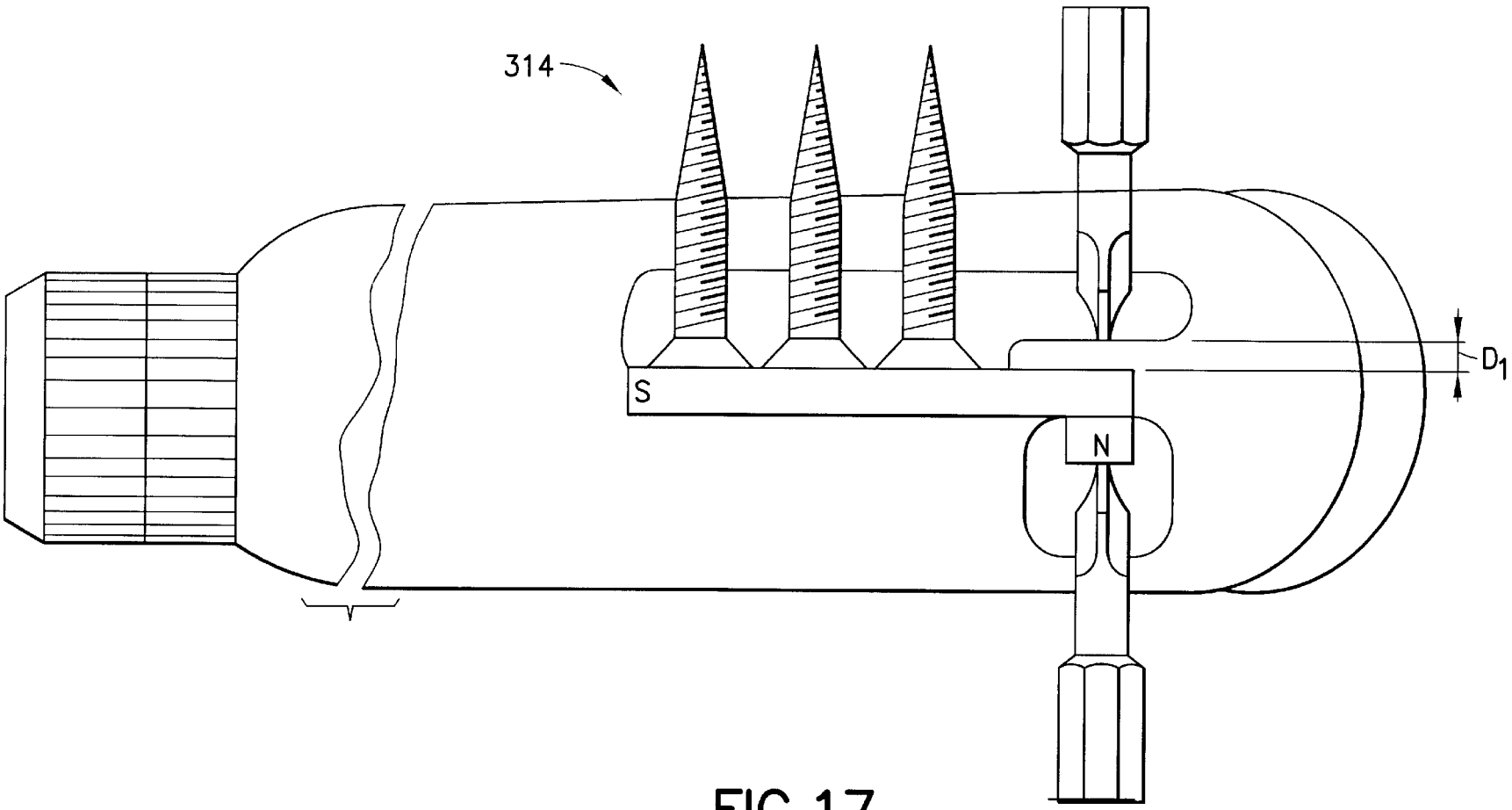
FIG. 17 is a broken foreshortened top view of a portable power screwdriver illustrating a super magnet/shunt magnetizer/demagnetizer unit integral with the rear portion of the power driver housing and also illustrating a Phillips driver screw bit positioned at the super magnet magnetizing portion of the magnetizer/demagnetizer and further illustrating a plurality of Phillips head screws, shown as three, magnetically attached to the holding area of the magnetizer/demagnetizer unit and further showing a Phillips driver bit positioned at the magnetizing position and further showing the Phillips driver bit positioned at the demagnetizing position.
Figure 18:
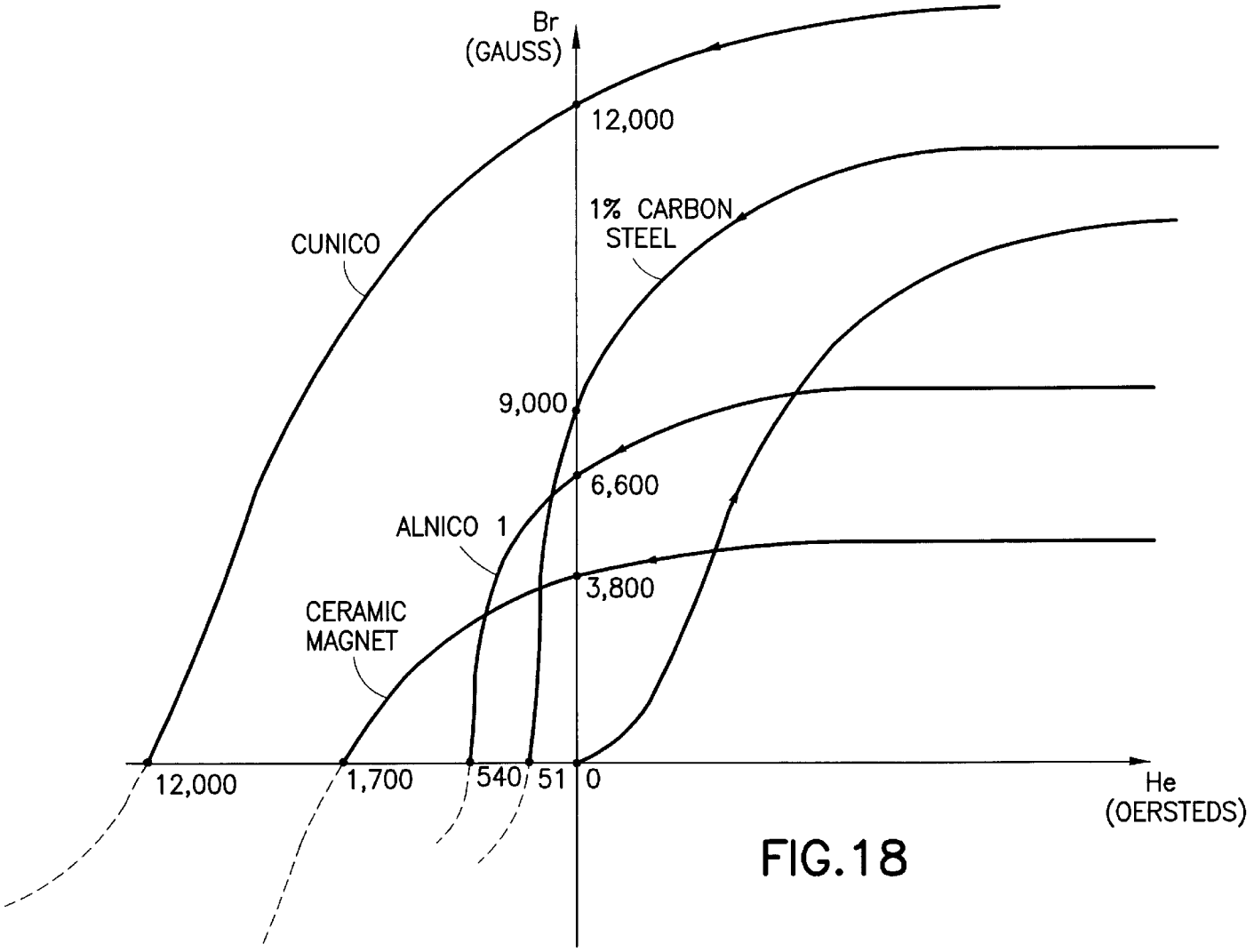
FIG. 18 illustrates partial magnetization curves for some typical or representative magnetizable materials, showing the magnetizing force required to initially saturate the magnetic materials and subsequently to demagnetize such materials.

FIG. 17 shows an alternate embodiment of the present invention where a magnetizer/demagnetizer 364 is mounted integral with a power driving tool 366 at a non-operative rear portion 368 positioned at the top rear area of power tool housing 370. Power driving tool 366 includes non-magnetizable housing 370 and a chuck 372 positioned over a handle (not shown). A permanent high energy elongated magnet 374 has a long dimension shown for purposes of exposition to be aligned with the longitudinal dimension of power driving tool 366 in accord with the plane from chuck 372 to non-operative portion 368.

Magnetizer/demagnetizer 364 includes an elongated magnet 374 comprising a super magnet portion 376 connected to the proximal end 378 of an elongated shunt portion 380, which has an opposed distal end 379 at the north pole N. A tool bit 382A has a tool bit tip 384A in magnetizing contact with the north pole N of elongated magnet 374 specifically at the north pole N at a first position 386. The same tool bit 382B has a tool bit tip 384B mounted in demagnetizing relationship to elongated magnet 374 at a second positi6n 388 associated with the proximal end of shunt portion 380 directly opposed to first position 386. Second position 388 is located at a distance $D_1$ from elongated magnet 374 specifically from shunt portion 380 as will be discussed. A number of screws, indicated as Phillips screws for purposes of exposition, and further as three Phillips screws 390A, 390B, and 390C again for purposes of exposition that have three screw heads 392A, 392B and 392C, respectively, are shown mounted in magnetic contact with elongated magnet 374 at a third position 394. Elongated magnet 374 defines a housing holding area 396 along a planar surface of elongated magnet 374 that accommodates screw heads 392A–C in direct magnetic contact and so magnetizes screw heads 392A–C and thus holds screws 390A–C on the surface of elongated magnet 374 by the force of magnetic attraction. Third position 394 is spaced from north pole N and is associated with south pole S. Thus, a user can transport the magnetically held screws along with the power driving tool in the same manner as screws 330A–C is transported along with the power driving tool 366 of magnetizer/demagnetizer 314 as previously described.

Housing holding area 396 is unitary with non-magnetizable housing 370, which is preferably made of a plastic material. Housing 370, in particular housing holding area 396, forms a first access specifically an access cavity 398 associated with first position 386. Housing 370, in particular holding area 396, further provides a second access specifically a second access cavity 400 associated with second position 388 for demagnification of tool bit 382A in particular bit tip 384A that is shown and indicated as tool bit 382B with tool bit tip 382B mounted with a structure that will be set forth. Housing holding area 396 also provides a third access cavity 402 associated with third position 394 for placement of three Phillips screws 390A–C at third position 394 on elongated magnet 374 in association with south pole S specifically on shunt portion 380 so that Phillips screw 390A–C are held by magnetic force to elongated magnet 374 and to magnetizer/demagnetizer 364 and thus to power driving tool 366 while a user carries power driving tool 366 to a work area. Third access cavity 402 and first access cavity 398 are shown as being continuous.

Housing 370, in particular housing holding area 396, defines an elongated rectangular recess 404 having a open top which is positioned elongated magnet 374 aligned with the longitudinal dimension of power driving tool 366. Housing 370, in particular holding area 396, further forms a subrecess 404 that adjoins recess 406 and in which is positioned super magnet portion 376 so that super magnet portion 376 has an exposed planar surface at first access cavity 398 that defines first position 386 at north pole N.

Tool bit 382A and in particular bit tip 384A is shown in FIG. 17 positioned in magnetizing contact and also shown in FIG. 17 positioned in magnetizing contact with elongated magnet 374 at first position 386 in particular positioned in first access cavity 398 for contact with the N pole. Tool bit 382A in particular bit tip 384A are magnetized by contact with elongated magnet 374 at first position 386. As shown in FIG. 17, housing holding area 396 creates a wall 408 at second position 388 separating elongated magnet 374 from first cavity 398 at second access cavity 400. Wall 408 has a thickness of a predetermined distance $D_1$ at second position 388 so that magnetized tool bit 384A in particular bit tip 382A are demagnetized at second position 388 by touching the same shown as tool bit 382B particularly tool bit tip 384B to wall 408 as shown in FIG. 17.

As shown in FIG. 17, Phillips screws 390A–C are magnetized by direct contact of Phillips screw heads 392A–C with elongated magnet 374 at third position 394 in third access cavity 402 opening to elongated magnet 374 while a user carries the power driving tool to a work area. In addition, after tool bit 382A particularly tool bit tip 384A has been magnetized at a north pole N, when the user removes one of the screws 390A–C from elongated magnet 374 and sets the selected screw at the work piece and then removes the magnetized tool bit 382A particularly magnetized tool bit tip 384A from first position 386 and connect the same with chuck 372. At the work place, the slots of the particular head of the selected screw of Phillips screws 390A–C, is held to magnetized tool bit 382A by the force of magnetic attraction. After the completion of the work, namely, driving the screw into the work piece, there would be no necessity to demagnetize the magnetized screw. Demagnetization of tool bit 382A is accomplished at second position 388.

It is important to note while the afore-described embodiments are primarily shown in connection with a power driving tools, the magnetizer/demagnetizer attachable unit of the present invention can be adhesively bonded to any desirable metallic or non-metallic surface, including by way of example, the top of a ladder, adjacent a work area, a tool box cover and the user's work belt, and such further combinations are within the contemplation of the present invention.

An important feature of the present invention is the provision of magnetic means adjacent the handle for establishing a magnetizing magnetic field accessible for selective placement of a magnetizable element within the field, with the magnetic means being formed by a permanently magnetized material having an energy product sufficiently high so that the size and volume of the permanent magnet can be made sufficiently small so that it can be mounted on or embedded within conventionally sized handles, even the generally smaller handles associated and used with precision screwdrivers. Since the magnetic energy content, or BH product, of a magnetic material is proportional to the volume of the magnet, it has been determined that in order to use permanent magnets with small volumes to be mountable on driver tool handles, the magnetic properties of the permanent magnet materials must be equal to at least $7.0\times10^6$ gauss-oersteds. Magnetic flux lines conventionally leave the North Pole and enter the South Pole, the magnetic flux lines being always closed curves that leave the North Pole and enter the South Pole and always maintain the same direction. Therefore, magnetic flux lines generally exhibit the same directions at both Pole surfaces, with the exception that the flux lines leave from the North Pole and enter into the South Pole. The placement of a soft magnetizable material proximate to either of the polar surfaces, therefore, has the same effect on the magnetic domains of the magnetizable material and would tend to either magnetize or demagnetize the magnetizable material at each of the poles. Since both poles have the same effect on a magnetizable element, it is generally necessary to have at least two permanent magnets which are so arranged so as to provide oppositely directed magnetic fields in order to establish reverse polarizing effects on the magnetizable element. Thus, if one of the magnetic poles of one of the permanent magnets provides a magnetizing effect, the other permanent magnet is preferably so arranged so that the placement of the magnetizable element next to one of its poles will have an opposite or demagnetizing effect.

Because conventional magnetic materials that have been used in the past for magnetizing and demagnetizing have had relatively low energy products BH, they could not be embedded or mounted on conventional driver tool handles. Even when attempts to do so have been made, only single bulky and weak magnets could be provided which would normally serve to magnetize components. However, in accordance with the present invention, two or more magnets can now be easily mounted and/or embedded within conventional driver tool handles, even the relatively small precision screwdriver handles, to provide strong magnetizing and demagnetizing fields.

FIG. 19 illustrates typical BH curves for different magnetizable materials. In each case, with the magnetizable material initially totally demagnetized, the curve M illustrates initial magnetization from the origin, such that as the magnetic intensity H is increased, the flux levels within the materials B are correspondingly increased. While initially such relationship may be relatively linear, magnetic materials saturate at a predetermined level such that increases in magnetic intensity H do not result in additional flux being generated. The remaining curves D1, D2, D3 and D4 illustrate the demagnetizing portions of the B-H curves for different magnetizable materials, namely, cunico, 1% carbon steel, alnico and ceramic magnets. It will be evident that these materials not only have different retentive values $B_r$ (at H=0) but also require different amounts of reverse magnetization in order to totally demagnetize these materials or revert these to the totally demagnetized states in which B=0. Thus, cunico has a retentive field of 12,000 gauss when demagnetizing force is removed and requires −12,000 oersteds to totally demagnetize the material. One percent carbon steel has a retentive magnetic field of 9,000 gauss when the magnetic intensity is removed, and requires only −51 oersteds to totally demagnetize such steel. Alnico has a somewhat lower retentive field of 6600 gauss, while requiring −540 oersteds to demagnetize the alnico, while a typical ceramic magnet has the lowest retentive field when magnetic intensity is removed, namely 3800 gauss, while a negative intensity of 1700 oersteds is required to demagnetize this material. Therefore, particularly for 1% carbon steel, alnico and ceramic magnets, it will be evident that the reverse magnetic intensities required to fully demagnetize these materials are relative low and substantially less than the intensities required to saturate and fully magnetize these materials. It is for this reason that the distances $d_1$ in each of the embodiments illustrated was selected to be less than the demagnetizing distances $d_2$.

While this invention has been described in detail with particular reference to preferred embodiments thereof, it will be understood that variations and modifications will be effected within the spirit and scope of the invention as described herein and as defined in the appended claims.

What I claim is:

1. A high energy magnetizer/demagnetizer in combination with a power driving tool including a magnetizable tool bit for driving the head of a fastening device or the like comprising an elongated permanent magnet having opposed first and second poles arranged on a non-operative portion of the driving tool or the like to permit placement of a magnetizable tool bit on said elongated magnet at a first position associated with said first pole to magnetize the tool bit and also to permit placement of the tool bit at a second position associated with said second pole to demagnetize the tool bit, said second position being at a predetermined distance from said magnet, said elongated magnet defining a holding area to permit magnetic holding of at least one fastening device at a third position on said elongated magnet associated with said second pole, and nonmagnetizable mounting means for holding said elongated magnet and for providing first and third accesses at said first and third positions, respectively, to said elongated magnet and for providing said predetermined distance at said second position.

2. The high energy magnetizer/demagnetizer as defined in claim 1, wherein said elongated magnet comprises a high energy magnet portion and an elongated ferromagnetic shunt portion, said high energy magnet portion being magnetically held to said shunt portion.

3. The high energy magnetizer/demagnetizer as defined in claim 2, having opposed elongated shunt ends, wherein said high energy magnet portion is disposed adjacent to one of said shunt ends.

4. The high energy magnetizer/demagnetizer as defined in claim 1, wherein said first position is associated with said high energy magnet portion and said second position is associated with said one of said elongated shunt ends and said third position is associated with the other of said elongated shunt ends.

5. The high energy magnetizer/demagnetizer as defined in claim 1, wherein said elongated magnet is a bar magnet.

6. The high energy magnetizer/demagnetizer as defined in claim 1, further including means for attaching said mounting means to a nonmagnetizable portion of a tool.

7. The high energy magnetizer/demagnetizer as defined in claim 6, wherein said tool is a driving tool having a tool housing having said nonmagnetizagle portion and said means for attaching said mounting means is an adhesive.

8. The high energy magnetizer/demagnetizer as defined in claim 7, wherein said means for attaching said mounting means to a nonmagnetizable portion of a tool is said nonmagnetizable portion of said tool housing being integral with said mounting means.

9. The high energy magnetizer/demagnetizer as defined in claim 1, wherein said mounting means is a holding body made of a non-magnetizable material.

10. The high energy magnetizer/demagnetizer as defined in claim 8, wherein said holding body includes a mounting base and a pair of opposed end walls connected to said mounting base and a pair of opposed side Walls connected to said end walls and to said mounting base, said mounting base, said end walls and said side walls defining a recess, said elongated magnet being positioned in said recess.

11. The high energy magnetizer/demagnetizer as defined in claim 10, wherein said mounting base is contoured to fit onto the non-operative portion of the housing of the power driving tool.

12. The high energy magnetizer/demagnitizer as defined in claim 11, wherein mounting base is a flexible mounting base made of a flexible material and further including flexible adhesive means for connecting said flexible mounting base to the power driving tool.

13. The high energy magnetizer/demagnetizer as defined in claim 12, wherein one of said side walls forms said first access to said elongated magnet at said first position, said other of said side walls having a thickness of said predetermined distance at said second position, whereby said tool bit is magnetized by contact with said elongated magnet at said first position and is demagnetized at said second position.

14. The high energy magnetizer/demagnetizer as defined in claim 13, wherein said other of said side walls forms said third access to said elongated magnet at said third position, whereby said fastening device is magnetized by contact with said elongated magnet at said third position.

15. The high energy magnetizer/demagnetizer as defined in claim 1, wherein the fastening device is a magnetizable screw.

16. The high energy magnetizer/demagnetizer as defined in claim 7, wherein said driving tool is a power driving tool.

17. The high energy magnetizer/demagnetizer as defined in claim 16, wherein said power driving tool is a Phillips power driving tool and said said magnetizable tool bit is a Phillips tool bit and said screw is a Phillips head screw.

18. The high energy magnetizer/demagnetizer as defined in claim 1, wherein said at least one fastening device is a plurality of fastening devices.

19. The high energy magnetizer/demagnetizer as defined in claim 1, wherein said elongated magnet has an energy product equal to at least $7.0\times10^6$ gauss-oersteds.

20. A high energy magnetizer/demagnetizer comprising:

an elongated permanent magnet having opposed first and second poles arranged on the housing of the driving toolor the like to permit placement of a magnetizable tool bit on said elongated magnet at a first position associated with said first pole to magnetize the tool bit and also to permit placement of the tool bit at a second position associated with said second pole to demagnetize the tool bit, said second position being at a predetermined distance from said magnet, said magnet having a holding area to permit placement of at least one fastening device at a third position on said elongated magnet associated with said second pole, and mounting means for holding said elongated magnet and for providing first and third accesses at said first and third positions, respectively, to said elongated magnet and for providing said predetermined distance at said second position.

21. The high energy magnetizer/demagnetizer as defined in claim 18, wherein said elongated magnet is a bar magnet.

22. The high energy magnetizer/demagnetizer as defined in claim 20, wherein said elongated magnet comprises a high energy magnet portion and an elongated shunt portion having opposed elongated shunt ends, said high energy magnet portion being connected to one of said elongated shunt ends.

23. The high energy magnetizer/demagnetizer as defined in claim 22, wherein said first position is associated with said high energy magnet portion and said second position is associated with said one of said elongated shunt ends and said third position is associated with the other of said elongated shunt ends.

24. The high energy magnetizer/demagnetizer as defined in claim 20, wherein the housing of the power driving tool is made of a non-magnetizable material and said mounting means is integral with said housing.

25. The high energy magnetizer/demagnetizer as defined in claim 20, wherein said mounting means is a holding body made of a non-magnetizable material.

26. The high energy magnetizer/demagnetizer as defined in claim 25, wherein said holding body includes a mounting base and a pair of opposed end walls connected to said mounting base and a pair of opposed side walls connected to said end walls, and to said mounting base, said mounting base, said end walls and said side walls defining an recess, said elongated magnet being positioned in said recess.

27. The high energy magnetizer/demagnetizer as defined in claim 26, wherein said mounting base is contoured to fit onto the housing of the power driving tool.

28. The high energy magnetizer/demagnetizer as defined in claim 27, further including adhesive means associated with said mounting base for connecting said holding body to the housing of the power driving tool.

29. The high energy magnetizer/demagnetizer as defined in claim 26, wherein said mounting base is a flexible mounting base made of a flexible material and further including flexible adhesive means for connecting said flexible mounting base to the power driving tool.

30. The high energy magnetizer/demagnetizer as defined in claim 26, wherein one of said side walls forms said first access to said elongated magnet at said first position associated with said first pole, said other of said side walls having a thickness of said predetermined distance at said second position, whereby said tool bit is magnetized by contact with said elongated magnet at said first position and is demagnetized at said second position.

31. The high energy magnetizer/demagnetizer as defined in claim 26, wherein the other of said side walls forms said third access to said elongated magnet at said third position, whereby said fastening device is magnetized by contact with said elongated magnet at said third position.

32. The high energy magnetizer/demagnetizer as defined in claim 20, wherein the fastening device is a screw.

33. The high energy magnetizer/demagnetizer as defined in claim 20, wherein said power driving tool is a Phillips driving tool and said magnetizable tool bit is a Phillips tool bit and said screw is a Phillips headscrew.

34. The high energy magnetizer/demagnetizer as defined in claim 20, wherein said at least one fastening device is a plurality of fastening devices.

35. The high energy magnetizer/demagnetizer as defined in claim 20, wherein said elongated magnet has an energy product equal to at least $7.0\times10^6$ gauss-oersteds.

36. A high energy magnetizer/demagnetizer comprising:

an elongated permanent magnet having opposed first and second poles arranged on the housing of the driving tool or the like to permit placement of a magnetizable tool bit on said elongated magnet at a first position associated with said first pole to magnetize the tool bit and also to permit placement of the tool bit at a second position associated with said second pole to demagnetize the tool bit, said second position being at a predetermined distance from said elongated magnet, said elongated magnet having a holding area to permit placement of at least one fastening device at a third position on said elongated magnet associated with said second pole, and mounting means for holding said elongated magnet and for providing first and third accesses at said first and third positions, respectively, to said elongated magnet and for providing said predetermined distance at said second position.

37. The high energy magnetizer/demagnetizer as defined in claim 36, wherein said elongated magnet comprises a high energy magnet portion and an elongated shunt portion having opposed elongated shunt ends, said high energy magnet portion being connected to one of said elongated shunt ends.

38. The high energy magnetizer/demagnetizer as defined in claim 37, wherein said first position is associated with said high energy magnet portion and said second position is associated with said one of said elongated shunt ends and said third position is associated with the other of said elongated shunt ends.

39. The high energy magnetizer/demagnetizer as defined in claim 36, wherein said mounting means is a holding body made of a non-magnetizable material.

40. The high energy magnetizer/demagnetizer as defined in claim 39 wherein said holding body includes a mounting base and a pair of opposed end walls connected to said mounting base and a pair of opposed side walls connected to said end walls and to said mounting base, said mounting base, said end walls and said side walls defining a recess, said elongated magnet being positioned in said elongated recess.

41. The high energy magnetizer/demagnetizer as defined in claim 40, wherein said elongated recess includes an elongated recess portion and a subrecess portion, said elongated shunt portion being positioned in said elongated recess portion and said super magnet being positioned in said subrecess portion.

42. The high energy magnetizer/demagnetizer as defined in claim 40, wherein one of said side walls defines a subrecess continuous with said recess, said super magnet being positioned in said subrecess, said super magnet being at said first position.

43. The high energy magnetizer/demagnetizer as defined in claim 42, wherein said one of said side walls forms said first access to said elongated magnet at said first position, the other of said side walls having a thickness of said predetermined distance at said second position, whereby said tool bit is magnetized by contact with said elongated magnet at said first position and is demagnetized at said second position.

44. The high energy magnetizer/demagnetizer as defined in claim 43, wherein said other of said side walls forms said third access to said elongated magnet at said third position, whereby said fastening device is magnetized by contact with said elongated magnet at said third position.

45. The high energy magnetizer/demagnetizer as defined in claim 36, wherein the fastening device is a screw.

46. The high energy magnetizer/demagnetizer as defined in claim 36, wherein said power driving tool is a Phillips driving tool and said magnetizable tool bit is a Phillips tool bit and said screw is a Phillips head screw.

47. The high energy magnetizer/demagnetizer as defined in claim 36, wherein said at least one fastening device is a plurality of fastening devices.

48. The high energy magnetizer/demagnetizer as defined in claim 40, wherein said mounting base is contoured to fit onto the non-operative portion of the power driving tool.

49. The high energy magnetizer/demagnetizer as defined in claim 40, wherein said mounting base is a flexible mounting base made of a flexible material and further including flexible adhesive means for connecting said flexible mounting base to the power driving tool.

50. The high energy magnetizer/demagnetizer as defined claim 36, wherein said elongated magnet has an energy product equal to at least $7.0\times10^6$ gauss-oersteds.

51. An attachable high energy magnetizer/demagnetizer unit comprising:

an elongated permanent magnet having opposed first and second poles to permit placement of a magnetizable tool bit on said elongated magnet at a first position associated with said first pole to magnetize the tool bit and also to permit placement of the tool bit at a second position associated with said second pole to demagnetize the tool bit, said second position being at a predetermined distance from said magnet, said elongated magnet defining a holding area to permit magnetic holding of at least one fastening device at a third position on said elongated magnet associated with second pole, mounting means for holding said elongated magnet and for providing first and third accesses at said first and third positions, respectively, to said elongated magnet and for providing said predetermined distance at said second position, and means for attaching said mounting means to a surface.

52. The attachable high energy magnetizer/demagnetizer unit of claim 51, said elongated permanent magnet comprising a high energy magnet and an elongated ferrometallic shunt, said high energy magnet being magnetically held to the shunt.

53. The attachable high energy magnetizer/demagnetizer unit of claim 52, said high energy magnet being disposed adjacent one end of the elongated shunt.

54. The attachable high energy magnetizer/demagnetizer unit of claim 51, said mounting means comprising a flexible plastic base.

55. The attachable high energy magnetizer/demagnetizer unit of claim 54, said means for attaching said mounting means comprising an adhesive secured to said flexible plastic base.

56. An attachable high energy magnetizer/demagnetizer unit comprising:

a permanent magnet having an energy product of at least about $6.0\times10^6$ gauss-oersteds and having of a first magnetizable tool on said magnet at a first position associated with said first pole to magnetize the tool and to permit placement of a second tool having a cross dimension greater than said first tool at a second first position associated with said first pole to magnetize the second tool also to permit placement of the first and second tools at a second position associated with said second pole to respectively demagnetize the tools, said second position being at a predetermined distance from said magnet, mounting means for holding said magnet and for providing said first positions and said second position, and means for attaching said mounting means to a surface.

57. The unit of claim 56, said magnet comprising a rare earth magnet.

58. The unit of claim 56, said mounting means comprising a flexible plastic base.

59. The unit of claim 56, said means for attaching said mounting means comprising an adhesive secured to said flexible plastic base.

60. The unit of claim 58, said means for attaching said mounting means comprising an adhesive secured to said flexible plastic base.

61. The unit of claim 56, said mounting means being formed with a first and second indicating means for indicating the first positions.

62. The unit of claim 61, said first and second indicating means comprising respective first and second grooves.

63. The unit of claim 56, wherein said mounting means comprising parallel elongated sides, and said first positions are transversely disposed to said sides.

64. The unit of claim 63, said moving means for attaching comprising an adhesive secured to said flexible base.

65. The unit of claim 62, said grooves being formed to receive the shank of a tool.

* * * * *